US011100830B2

(12) United States Patent
Aksit

(10) Patent No.: US 11,100,830 B2
(45) Date of Patent: Aug. 24, 2021

(54) METHOD AND APPARATUS FOR SPATIOTEMPORAL ENHANCEMENT OF PATCH SCANNING DISPLAYS

(71) Applicant: NVIDIA Corporation, Santa Clara, CA (US)

(72) Inventor: Kaan Aksit, Mountain View, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 16/741,397

(22) Filed: Jan. 13, 2020

(65) Prior Publication Data

US 2021/0217338 A1 Jul. 15, 2021

(51) Int. Cl.
*G09G 3/02* (2006.01)
*G09G 3/34* (2006.01)

(52) U.S. Cl.
CPC ..... *G09G 3/02* (2013.01); *G09G 3/3406* (2013.01); *G09G 2320/0626* (2013.01)

(58) Field of Classification Search
CPC . G09G 3/02; G09G 3/3406; G09G 2320/0626
See application file for complete search history.

(56) References Cited

U.S. PATENT DOCUMENTS 1,699,270 A 1/1929 Baird
4,160,972 A 7/1979 Berlin, Jr.
6,831,678 B1 * 12/2004 Travis ..... G03H 1/2294 348/46
8,371,698 B2 * 2/2013 Brown ..... G09G 3/02 353/34
2003/0128407 A1 * 7/2003 Chien ..... H04N 1/04 358/474
2004/0239885 A1 * 12/2004 Jaynes ..... H04N 9/3147 353/30

(Continued)

OTHER PUBLICATIONS

Khoulieris, G, et al., "Near-eye display and tracking technologies for virtual and augmented reality," In Computer Graphics Forum, vol. 38, pp. 493-519 (Wiley Online Library, 2019).

(Continued)

*Primary Examiner* — Grant Sitta
(74) *Attorney, Agent, or Firm* — Leydig, Voit & Mayer, Ltd.

(57) ABSTRACT

A patch scanning display apparatus and a technique for reconstructing a target image frame on a projection surface is disclosed. The patch scanning display apparatus includes a backlight and a spatial light modulator (SLM). An optical scanning device scans the image projected by the SLM across the projection surface in accordance with a scan trajectory. A decomposition model is used to generate a set of image patches based on the target image frame and the scan trajectory. In an embodiment, the decomposition model is a projective non-negative matrix factorization model. The set of image patches are utilized to generate a modulation signal for the SLM and a binary backlight signal is then generated for each time step of the scan trajectory within a frame period to activate or deactivate the light-emitting elements of the backlight during the frame period at a high refresh rate while the projected image is scanned.

15 Claims, 12 Drawing Sheets

(56) References Cited

U.S. PATENT DOCUMENTS

2008/0048979 A1* 2/2008 Ruttenberg ..... G06F 1/1694 345/158
2009/0219387 A1* 9/2009 Marman ..... H04N 5/235 348/143
2011/0221966 A1* 9/2011 Hsieh ..... G06T 3/4053 348/665
2011/0310121 A1* 12/2011 Baron ..... H04N 13/395 345/634
2012/0041725 A1* 2/2012 Huh ..... G06K 9/6252 703/2
2012/0113064 A1* 5/2012 White ..... G06F 3/04184 345/178
2013/0008181 A1* 1/2013 Makansi ..... F25B 21/04 62/3.3
2013/0201403 A1* 8/2013 Iversen ..... H04N 13/337 348/659
2013/0293591 A1* 11/2013 Miller ..... G03B 21/2033 345/690
2014/0184669 A1* 7/2014 Oh ..... G09G 5/377 345/694
2015/0168733 A1* 6/2015 Rumreich ..... G02B 26/103 348/744
2015/0310798 A1* 10/2015 Heide ..... G09G 3/36 345/55
2016/0258906 A1* 9/2016 Lennox ..... G01N 29/46
2018/0176551 A1* 6/2018 Viswanathan ..... H04N 9/3161

OTHER PUBLICATIONS

Roberts, J., et al., "Flicker can be perceived during saccades at frequencies in excess of 1 khz," Lighting Research & Technology 45, pp. 124-132 (2013).
Liu, J., et al., "When does the hidden butterfly not flicker?" In Siggraph Asia Technical Briefs, 3-1, 2014.
Davis, J., et al., "Humans perceive flicker artifacts at 500 hz.," Scientific Reports 5, 7861 (2015).
Noland, K., et al., "The application of sampling theory to television frame rate requirements," BBC Research & Development White Paper 282 (2014).
Khoei, M., et al., "Faster is better: Visual responses to motion are stronger for higher refresh rates," bioRxiv 505354 (2018).
Kime, S., et al., "Psychophysical assessment of perceptual performance with varying display frame rates," Journal of Display Technology 12, 1372-1382 (2016).
Sajadi, B., et al., "Edge-guided resolution enhancement in projectors via optical pixel sharing," ACM Transactions on Graphics (TOG) 31, 79 (2012).
Jaynes, C., et al., "Super-resolution composition in multi-projector displays," In IEEE Int'l Workshop on Projector-Camera Systems, vol. 8 (2003).
Heide, F., et al., "Cascaded displays: spatiotemporal superresolution using offset pixel layers," ACM Transactions on Graphics (TOG) 33, 60 (2014).
Allen, W., et al., "Invited paper: Wobulation: Doubling the addressed resolution of projection displays," In SID Symposium Digest of Technical Papers, vol. 36, 1514-1517 (Wiley Online Library, 2005).
Berthouzoz, F., et al., "Resolution enhancement by vibrating displays," ACM Transactions on Graphics (TOG) 31, 15 (2012).
Sajadi, B., et al., "Image enhancement in projectors via optical pixel shift and overlay," In IEEE International Conference on Cmputational Photography (ICCP), 1-10 (IEEE, 2013).
Didyk, P., et al., "Apparent display resolution enhancement for moving images," ACM Transactions on Graphics (TOG) 29, 113 (2010).
Lee, H., et al., "Real-time apparent resolution enhancement for head-mounted displays," Proceedings of the ACM on Computer Graphics and Interactive Techniques 1, 19 (2018).
Kim, J., et al., "Foveated ar: dynamically-foveated augmented reality display," ACM Transactions on Graphics (TOG) 38, 99 (2019).
Aksit, K., et al., "Manufacturing application-driven foveated near-eye displays," IEEE transactions on visualization and computer graphics (2019).
Zhang, R., et al., "The unreasonable effectiveness of deep features as a perceptual metric," In Proceedings of the IEEE Conference on Computer Vision and Pattern Recognition, 586-595 (2018).
Yuan, Z., et al., "Projective nonnegative matrix factorization for image compression and feature extraction," In Scandinavian Conference on Image Analysis, 333-342 (Springer 2005).
Buck, J., et al., "Polarization gratings for non-mechanical beam steering applications," In Acquisition, Tracking, Pointing, and Laser Systems Technologies XXVI, vol. 8395, 83950F (International Society for Optics and Photonics, 2012).
McManamon, P., et al., "A review of phased array steering for narrow-band electrooptical systems," Proceedings of the IEEE 97, 1078-1096 (2009).
Hoang, T., et al., "Ultrafast spontaneous emission source using plasmonic nanoantennas," Nature communications 6, 7788 (2015).
Lincoln, P., et al., "From motion to photons in 80 microseconds: Towards minimal latency for virtual and augmented reality," IEEE transactions on visualization and computer graphics 22, 1367-1376 (2016).
Pattanaik, S., et al., "Time-dependent visual adaptation for fast realistic image display," In Proceedings of the 27th annual conference on computer graphics and interactive techniques, 47-54 (ACM Press/Addison-Wesley Publishing Co. 2000).
Rinner, O., et al., "Time course of chromatic adaptation for color appearance and discrimination," Vision research 40, 1813-1826 (2000).
Lee, D., et al., "Algorithms for non-negative matrix factorization," In Advances in neural information processing systems, 556-562 (2001).
Beigbeder, T., et al., "The effects of loss and latency on user performance in unreal tournament 2003," In Proceedings of 3rd ACM SIGCOMM workshop on Network and system support for games, 144-151 (ACM, 2004).
Stengel, M., et al., "Optimizing apparent display resolution enhancement for arbitrary videos," IEEE Transactions on Image Processing 22, 3604-3613 (2013).
Song, W., et al., "Volumetric display based on multiple mini-projectors and a rotating screen," Optical Engineering 54, 013103 (2015).
Yoshida, T., et al., "Phyxel: Realistic display of shape and appearance using physical objects with high-speed pixelated lighting," In Proceedings of the 29th Annual Symposium on User Interface Software and Technology, 453-460 (ACM, 2016).
Yokota, T., et al., "Magic zoetrope: representation of animation by multilayer 3d zoetrope with a semitransparent mirror," In SIGGRAPH Asia 2018 Emerging Technologies, 8 (ACM, 2018).
Buckle, J., et al., "Harp/acsis: a submillimeter spectral imaging system on the jame clerk Maxwell telescope," Monthly Notices of the Royal Astronomical Society 399, 1026-1043 (2009).
Masia, B., et al., "A survey on computational displays: Pushing the boundaries of optics, computation, and perception," Computers & Graphics 37, 1012-1038 (2013).
Elliott, D.B., et al., "Visual acuity changes throughout adulthood in normal, healthy eyes: seeing beyond 6/6," Optometry and vision science: official publication of American Academy of Optometry 72, 186-191 (1995).
Kelly, D., "Motion and vision. ii stabilized spatio-temporal threshold surface," Josa 69, 1340-1349 (1979).
Vieri, C., et al., "An 18 megapixel 4.3 1443 ppi 120 hz oled display for wide field of view high acuity head mounted displays," Journal of the Society for Information Display 26, 314-324 (2018).
Wu, J., et al., "Resolution enhanced light field near eye display using e-shifting method with birefringent plate," Journal of the Society for Information Display 26, 269-279 (2018).
Sitter, B., et al., "78-3: Screen door effect reduction with diffractive film for virtual reality and augmented reality displays," In SID Symposium Digest of Technical Papers, vol. 48, 1150-1153 (Wiley Online Library, 2017).
Urey, H., et al., "Display and imaging systems," MOEMS and Applications (2005).

(56) References Cited

OTHER PUBLICATIONS

Urey, H., "Optical advantages in retinal scanning displays," In Helmet and Head-Mounted Displays V, vol. 4021, 20-26 (International Society for Optics and Photonics, 2000).
Kuroki, Y., et al., "A psychophysical study of improvements in motion-image quality by using high frame rates," Journal of the Society for Information Display 15, 61-68 (2007).
Swift, D., "Image rotation devices—a comparative survey," Optics & Laser Technology 4, 175-188 (1972).
Leach, J., et al., "Interferometric methods to measure orbital and spin, or the total angular momentum of a single photon," Physical review letters 92, 013601 (2004).
Miyashita, L., et al., "High-speed image rotator for blur-cancelling roll camera," In 2015 IEEE/RSJ International Conference on Intelligent Robots and Systems (IROS), 6047-6052 (IEEE, 2015).
Hamilton, A., et al., "Local light-ray rotation," Journal of Optics A: Pure and Applied Optics 11, 085705 (2009).
Xiong, J., et al., "Nonmechnical programmable image rotator with glan-thompson prism," In Optical Information Systems II, vol. 5557, 124-132 (International Society for Optics and Photonics, 2004).
Zhou, H., et al., "Tunable image rotator of light with optical geometric transformation," IEEE Photonics Journal 8, 1-7 (2016).
Reinhard, E., et al., High dynamic range imaging: acquisition, display, and image-based lighting (Morgan Kaufmann, 2010).

* cited by examiner

METHOD AND APPARATUS FOR SPATIOTEMPORAL ENHANCEMENT OF PATCH SCANNING DISPLAYS

TECHNICAL FIELD

The present disclosure relates to display technology. More specifically, the present disclosure presents a technique for spatiotemporal enhancement techniques implemented using a patch scanning display.

BACKGROUND

Emerging technology related to virtual reality (VR), augmented reality (AR), and electronic gaming (e.g., e-sports) necessitate increased pixel density and higher frame rates for displaying computer-generated images in next-generation display technology. The goal of increased spatiotemporal quality is related to the characteristics of the human visual system (HVS). One common characteristic of the HVS is that the fovea has a resolution of approximately 30 cycles per degree (cpd). Although commodity desktop displays having a resolution of 4 k often meet this criteria at common viewing distances, head-mounted displays that are positioned much closer to the user's eye often have trouble meeting this resolution. The physical size of individual pixels in the display may limit the effective resolution of these displays to approximately 5-10 cpd. Increasing the pixel density is difficult due to the small size of the pixels required and the physical limitations of conventional technology such as liquid crystal display (LCD) or organic light emitting diode (OLED) pixel elements.

Another characteristic of the HVS is related to a critical flicker fusion (CFF) threshold, which is somewhere in the range of 60-90 Hz. While conventional frame presentations rates of 60-120 Hz are common, and near or above the CFF threshold, there are some studies that the HVS can perceive some artifacts from presentation rates up to even 500 Hz, well above the typical frame refresh rate of most current display devices. Some studies also suggest that, even if frame presentation rates are above the CFF threshold, subjective viewing perception can improve at higher frame presentation rates. Therefore, both higher presentation rates and improved pixel density are critical components to improving the viewing experience of next-generation displays.

However, there are challenges with manufacturing displays with higher pixel density. As the envelope of individual pixel elements shrinks, the likelihood of a pixel having a defect increases. Further, with the increased pixel count, the likelihood of an entire display being defect free decreases. The failure rates related to manufacturing higher pixel density displays can therefore drive the cost of these displays up.

To this end, some display manufacturers have experimented with increasing pixel density using multiple cascaded spatial light modulators (SLMs). For example, Sajadi et al., "Edge-guided resolution enhancement in projectors via optical pixel sharing," ACM Transactions on Graphics (TOG) 31, 79 (2012), illustrates a technique combining two SLMs and a lenslet array to increase spatial resolution of a display. As another example, Jaynes et al., "Super-resolution composition in multi-projector displays," IEEE Int'l Workshop on Pojector-Camera Systems, vol. 8 (2003), illustrates a technique that overlaps multiple images from multiple projectors to improve spatial resolution. Alternatively, others are seeking to increase spatial resolution using temporal means. For example, Allen et al., "Wobulation: Doubling the addressed resolution of projection displays," SID Symposium Digest of Technical Papers, vol. 36, 1514-1517 (2005), introduces a technique, refered to as "Wobulation," where sub-frames from a digital micro-mirror device (DMD) are shifted optically by fractions of a pixel to form a perceived image with increased spatial resolution.

While these techniques offer improvements to perceived picture quality, they are still limited by the spatial resolution and refresh rate of the SLMs. For example, in order to display 5 sub-frames per frame an SLM operated at frame refresh rates of 60 Hz would need to be refreshed at 300 Hz. Furthermore, these techniques still benefit from improving the pixel density of the SLM, which is limited by manufacturing considerations discussed above. Thus, there is a need for addressing these issues and/or other issues associated with the prior art.

SUMMARY

A method, computer readable medium, and system are disclosed for reconstructing a target image frame using a patch scanning technique. The target image frame is analyzed to determine a set of basis functions associated with the target image frame in accordance with a scan trajectory. The set of basis functions are transformed into a modulation signal for a spatial light modulator of a patch scanning display. A backlight signal is then generated based on the modulation signal and the scan trajectory.

A method for reconstructing a target image frame using a patch scanning technique is disclosed. The method includes the steps of receiving the target image frame; generating a set of image patches corresponding to the target image frame in accordance with a decomposition model and a scan trajectory; generating a modulation signal for a spatial light modulator (SLM) based on the set of image patches; and generating a backlight signal for a backlight for each time step in a plurality of time steps of the scan trajectory.

In some embodiments, the method further includes the step of transmitting the modulation signal and the backlight signal to a patch scanning display to project a reconstructed version of the target image frame on a projection surface. The patch scanning display can include the backlight, the spatial light modulator, and an optical scanning device. The backlight includes a two-dimensional array of light-emitting elements that are activated or deactivated in accordance with the backlight signal. The spatial light modulator includes a two-dimensional array of light-modulating elements that are configured to modulate an amplitude and/or a phase of light emitted from the light-emitting elements of the backlight in accordance with the modulation signal. The optical scanning device is configured to project an image formed by the spatial light modulator onto the projection surface in accordance with the scan trajectory.

In some embodiments, each light-emitting element includes a plurality of light sources, and each light source emitting light of a particular color of a plurality of different colors. The light sources can include one of light-emitting diodes, microLEDs, organic LEDs, or lasers. In some embodiments, each light-modulating element includes one or more of: a liquid crystal display element or a digital micro-mirror device element.

In some embodiments, the decomposition model comprises a projective non-negative matrix factorization model. In an embodiment, generating the set of image patches includes, for each color channel of the target image frame, generating an input data matrix for each time step of the scan trajectory by vectorising a plurality of image tiles of a transformed version of the target image frame corresponding to the time step of the scan trajectory, determining a plurality of basis functions using the projective non-negative matrix factorization model based on the input data matrices for a number of time steps, and transforming the plurality of basis functions into image patches for the color channel. Generating the set of image patches also includes superimposing the image patches for each color channel to generate the set of image patches.

In some embodiments, determining the plurality of basis functions includes updating a matrix W according to a multiplicative update rule given by the following equation:

$$W_{xy} \leftarrow W_{xy} \frac{(VV^T W)_{xy}}{(WW^T VV^T W)_{xy} - (VV^T WW^T W)_{xy}}$$

In the equation, V represents the input data matrix for a particular time step.

In some embodiments, generating the backlight signal includes, for each time step of the scan trajectory signal, calculating, for each light-emitting element of the backlight, a difference between a target image frame and a reconstructed image at one or more locations corresponding to the light-emitting element. The reconstructed image is determined in accordance with the following equation:

$$R(x, y) = \sum_{t=t_0}^{t_n} T((O_t \odot S_t),\ t)\left(1 - e^{\frac{t_n - t}{\tau}}\right),$$

In the equation, $O_t \odot S_t$ represents an element-wise multiplication of the backlight signal $O_t$ at time step t with modulation signal $S_t$, T represents a transformation based on the scan trajectory, $t_n$ represents a number of time steps in a frame period, and x represents a time constant associated with a human visual system. Generating the backlight signal also includes, for each time step of the scan trajectory signal, determining the backlight signal at that time step based on the difference.

In some embodiments, the decomposition model comprises a truncated single value decomposition model or a neural network model.

In some embodiments, the set of image patches, the modulation signal, and the backlight signal are generated by a parallel processing unit.

In some embodiments, the scan trajectory is classified as one of scanline scanning, sinusoidal scanning, rotating scanning, or spiral scanning.

In some embodiments, the backlight signal is encoded based on an encryption key. The method further includes receiving a request for the encryption key from a client. The request includes credentials utilized to determine whether the client is permitted access to reconstruct the target image frame.

A patch scanning display apparatus is disclosed that includes a backlight that includes a two-dimensional array of light-emitting elements, a spatial light modulator that includes a two-dimensional array of light-modulating elements, and an optical scanning device. Each light-emitting element of the backlight corresponds to a plurality of light-modulating elements of the spatial light modulator, and light generated by the light-emitting elements in accordance with a backlight signal is modulated as the light is transmitted through the light-modulating elements in accordance with a modulation signal. The optical scanning device is configured to scan the image projected by the SLM on a projection surface in accordance with a scan trajectory. The backlight signal and the modulation signal for a target image frame are generated by: analyzing the target image frame to generate a set of image patches based on a decomposition model and the scan trajectory; generating the modulation signal based on the set of image patches; and generating, for each time step of the scan trajectory, the backlight signal based on a difference between the target image frame and a reconstructed image in accordance with the set of image patches and the scan trajectory.

In some embodiments, the patch scanning display apparatus further includes a controller configured to: receive the target image frame via a video interface; and generate the modulation signal and the backlight signal. In some embodiments, the backlight signal and the modulation signal are received from a controller via an interface.

In some embodiments, the set of image patches, the backlight signal, and the modulation signal for the patch scanning display apparatus are generated in the manner of the method set forth above.

A non-transitory computer-readable media storing computer instructions for reconstructing a target image frame using a patch scanning technique is disclosed. The instructions, when executed by one or more processors, cause the one or more processors to perform the steps of the method set forth above.

DETAILED DESCRIPTION

Figure 1A:
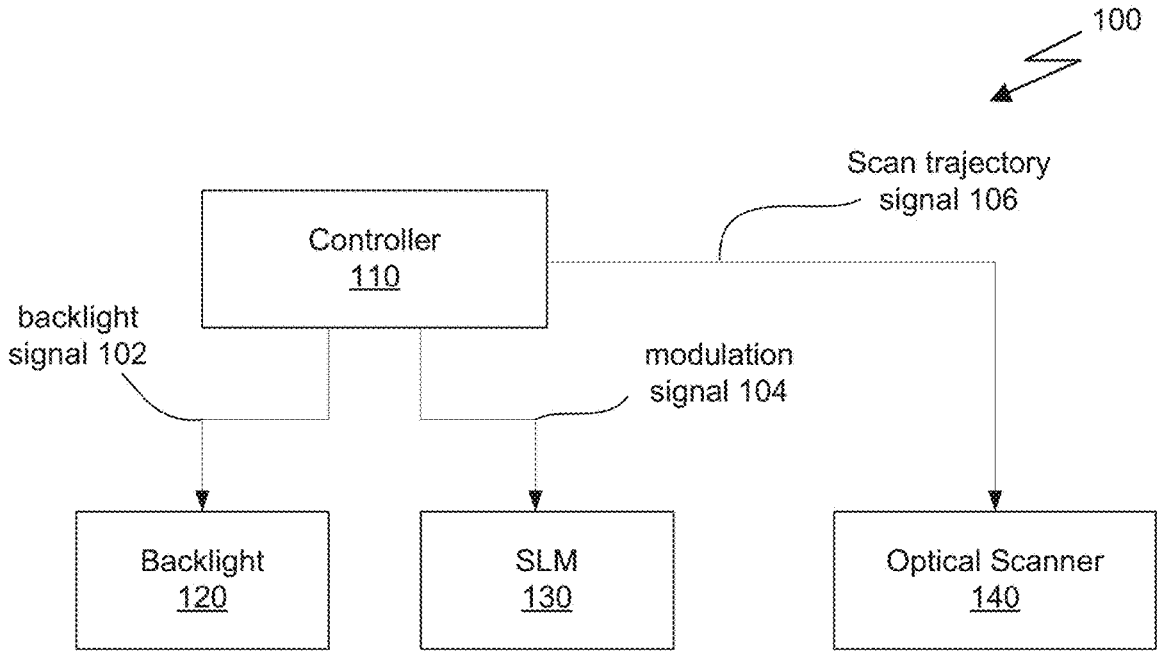
FIG. 1A illustrates a system configured to display a target image frame using a path scanning technique, in accordance with some embodiments.

Patch Scanning Displays (PSDs) can synthesize images with enhanced spatio-temporal resolutions by scanning multi-pixel image patches over a scan trajectory within a period of time referred to as a frame period. Due to the nature of the HVS, the rods and cones in the viewer's retina do not adjust instantaneously. Therefore, when light activates these structures there is a residual signal that persists and decays over a period of time. The residual signal is combined with the instantaneous intensity of light to generate the perceived intensity of light at that position of the user's retina. Thus, displaying a series of overlapping images on a projection surface, as viewed by a person, causes the person to perceive an image that is essentially a linear combination of the series of overlapping images, where the combination can be modeled with coefficients for each image representing the amount of decay in the signal related to a time since that particular image was projected on the projection surface.

Instead of displaying a static image fixed in space over a long period of time (e.g., a frame period) to allow the viewer to perceive the static image, the PSD can be configured to display a static image varying in space over that period of time such that the perceived image is some linear combination of offset versions of the static image over time. The offset of the image can be controlled according to a fixed scan trajectory. Furthermore, portions of the static image can be activated or deactivated (e.g., turned on or turned off) at any instantaneous point in time during the scan trajectory to modulate the portions of each offset version of the static image that contribute to the signal generated by the user's retina. This allows for a slow SLM operating at 60-120 Hz to be combined with a fast incoherent light source operating at many kilohertz to increase the perceived spatio-temporal resolution of the PSD with conventional hardware.

One technique for driving a PSD is to vectorize a target image to generate an input data matrix for a decomposition model in order to generate basis functions that can be combined to form a set of N image patches tiled on the SLM. As used herein, the term "vectorize" refers to transforming subsets of the target image frame, each subset referred to as an image tile and having dimension m columns by n rows, into a column of the input data matrix according to raster scan order (e.g., reading each data element across the rows of the image tile sequentially row by row from, e.g., top to bottom of the image tile). In an embodiment, the decomposition model is a modified projective non-negative matrix factorization (P-NMF) model, where learned basis functions are considered based on a scan trajectory of the PSD. The learned basis functions have dimensions of m×n, which matches the size of image tiles of the target image frame used in the original vectorization. In other embodiments, the decomposition model can be a truncated singular value decomposition (tSVD) model. In yet other embodiments, the decomposition model can be a neural network model. The neural network is trained using input target image frames and corresponding target sets of basis functions. After the model is trained, the neural network model consumes target image frames and outputs estimated basis functions. The basis functions are then combined to define the set of image patches used to generate a modulation signal for the SLM of the PSD. Once the basis functions have been learned, the backlight signal at each discrete time step of the scan trajectory can be generated by calculating the difference between the target image frame and a reconstructed image up until that time step to determine whether the light-emitting elements of the backlight are activated or deactivated during that time step.

In one embodiment, the basis functions can be learned by solving an optimization problem by applying a multiplicative update rule over a number of time steps of the scan trajectory. This is a machine learning optimization that can be performed using parallel processing units.

FIG. 1A illustrates a system 100 configured to display a target image frame using a path scanning technique, in accordance with some embodiments. As depicted in FIG. 1A, a backlight 120, a spatial light modulator (SLM) 130, and an optical scanning device 140 are connected to a controller 110. The backlight 120, SLM 130, and optical scanning device 140 are included in a PSD. In some embodiments, the controller 110 is included in the PSD. For example, the PSD can include a video signal interface such as a display port interface or the like. The video signal received via the video signal interface defines a sequence of target image frames with a frame rate of, e.g., 60-120 Hz. The controller 110 can be configured to analyze each target image frame to generate the required backlight signal 102, modulation signal 104, and/or scan trajectory signal 106 in order to reproduce the target image frame using the PSD. The controller 110 can be an enhanced timing controller (TCON) of the PSD implemented as an application specific integrated circuit (ASIC), digital signal processor (DSP), parallel processing unit (PPU), or the like.

In other embodiments, the controller 110 is external to the PSD. For example, the controller 110 can be a central processing unit (CPU), PPU, system-on-chip (SoC) including one or more CPU cores and/or one or more graphics processing unit (GPU) cores, or the like. In such embodiments, the controller 110 generates the backlight signal 102, modulation signal 104, and/or scan trajectory signal 106 externally to the PSD and transmits these signals to the PSD via a video interface. However, as discussed in more detail below, the bandwidth required for these signals may be significant and, as such, conventional video interfaces such as existing display port (DP) interfaces or the like may lack sufficient bandwidth to accommodate these signals. Therefore, the required interface may be proprietary or a combination of an in-band video interface used for the modulation signal 104 with an out-of-band video interface used for the high-speed backlight signal 102.

In some embodiments, the controller 110 is configured to generate a set of image patches based on a target image frame and a scan trajectory of the optical scanning device 140. Once the controller 110 has identified the set of image patches, a modulation signal 104 is generated for the SLM 130 in order to tile the image patches across the SLM 130 for a frame period. The controller 110 is also configured to generate a backlight signal for the backlight 120 in accordance with the set of image patches and the scan trajectory. Again, the controller 110 performs computations through one or more graphics processing units (GPU), central processing units (CPU), application specific integrated circuit (ASIC), microcontroller, or any other hardware or software component configured to implement the functionality described herein. In some embodiments, the controller 110 can be configured to use a cloud-based service that processes one or more target image frames and generates the set of image patches, modulation signal, and/or backlight signal. In other words, target image frames can be provided to a service available over a network, such as through an application programming interface (API), that returns one or more of the set of image patches, the modulation signal, and/or the backlight signal to a host node/processor.

In some embodiments, the backlight 120 includes a two-dimensional array of light-emitting elements. In an embodiment, the backlight 120 includes a set of multi-colored incoherent light sources such as LEDs, OLEDs, and the like. For example, the backlight array can include red, green, and blue LEDs as the light-emitting elements. In other embodiments, the backlight 120 includes a set of mono-color light sources such as white LEDs, which may include a broad spectrum of wavelengths.

The backlight 120 includes a two-dimensional array of light-emitting elements that vary in intensity to illuminate different portions of the SLM 130 in accordance with the backlight signal 102. The scan trajectory of the optical scanning device 140 can be divided into a number of discrete time steps $t_n$, where the scan trajectory is defined as a transformation T applied to the image projected by the SLM 130 during a frame period. The backlight signal 102 includes a binary value (e.g., 0 or 1) that indicates, for each time step in the frame period, whether a particular light-emitting element of the backlight 120 is activated or deactivated. As used herein, activating a light-emitting element refers to supplying power to the light-emitting element to emit light of a given wavelength or range of wavelengths at a full intensity of the light-emitting element, and deactivating a light-emitting element refers to removing power to the light-emitting element to cease emitting light.

In various embodiments, the light-emitting elements can utilize incoherent or coherent light sources. In some embodiments, the light-emitting elements can include lasers, LEDs or micro LEDs, which are considered good candidates as these light sources exhibit short response time. In other embodiments, the light-emitting elements can include OLEDs or micro LEDs, which can be densely populated on a substrate. The disclosed embodiments are discussed in the context of incoherent light sources such as LEDs, which require a non-negativity constraint. In embodiments that use coherent light sources, the non-negativity constraint may be relaxed because it could be possible to configure light-modulating elements to exploit the interference between light of specific wavelengths by modulating the phase of two light sources. Consequently, the basis functions could include negative values that represent this type of interference attenuation of multiple light sources.

In some embodiments, the SLM 130 includes a two-dimensional array of light modulating elements. Upon receiving the modulating signal from the controller 110, the SLM 130 is updated to reflect the target image patches. In some embodiments, the light-modulating elements include a transmissive liquid crystal display (LCD) element, which is configured to modulate the amplitude of light transmitted through the LCD element. In other embodiments, the SLM 130 can include other kinds of light-modulating elements configured to modulate an amplitude and/or a phase of light projected through the light-modulating elements. For example, the SLM 130 can include an electrically-addressed spatial light modulator (EASLM) that creates and modulates the image electronically. Examples of EASLM include a digital micromirror device (DMD), ferroelectrica liquid crystals on silicon (FLCoS), and nematic liquid crystals. As another example, the SLM 130 can include an optically-addressed spatial light modulator (OASLM) that creates and modulates the image, where the modulation signal OASLM is provided to a photosensor via a laser or an intermediate EASLM that projects an image onto the photosensor. Typically, EASLMs are operated at higher frequencies than OASLMs.

The optical scanning device 140 is configured to scan the image produced by light passing through the SLM 130 onto a projection surface in accordance with the scan trajectory. In some embodiments, the scan trajectory is fixed such that the optical scanning device 140 periodically scans the projected image according to the scan trajectory. In such embodiments, the controller 110 is aware of the scan trajectory, but the scan trajectory signal 106 may not need to be transmitted to the optical scanning device 140 (e.g., the scan trajectory signal 106 may be stored internally within the optical scanning device 140 or the scan trajectory may be implemented using electro-mechanical actuation not reflective of a signal per se—such as gears and a constant DC power moving a reflective surface in a periodic and repeating manner).

In other embodiments, the scan trajectory signal 106 can be selected by the controller 110 and transmitted to the optical scanning device 140. In these embodiments, the controller 110 may be optionally configured to select different scan trajectories from a set of available scan trajectories in order to reconstruct the target image frame on the projection surface. For example, the scan trajectories can include traditional scanline scanning and/or sinusoidal scanning. These scan trajectories transform the projected image in two degrees of freedom (e.g., translation in x and y dimensions). However, other scan trajectories can be included such as scan trajectories that add additional degrees of freedom (e.g., rotation in addition to translation) or a spiral scanning trajectory.

In some embodiments, the optical scanner 140 includes a charge-coupled device (CCD) scanner configured to redirect the light based on an electrical signal. In other embodiments, the optical scanner 140 includes a MEMS scanner configured to redirect the light based on an electrical signal and displacement of the orientation of one or more mirrors. In other embodiments, the optical scanning device 140 can be implemented as a non-mechanical scanner. Non-Mechanical scanners can include liquid crystal based switchable polarization grating cascades or liquid crystal based phased arrays in addition to optical components such as prisms and/or mirrors.

Figure 1B:
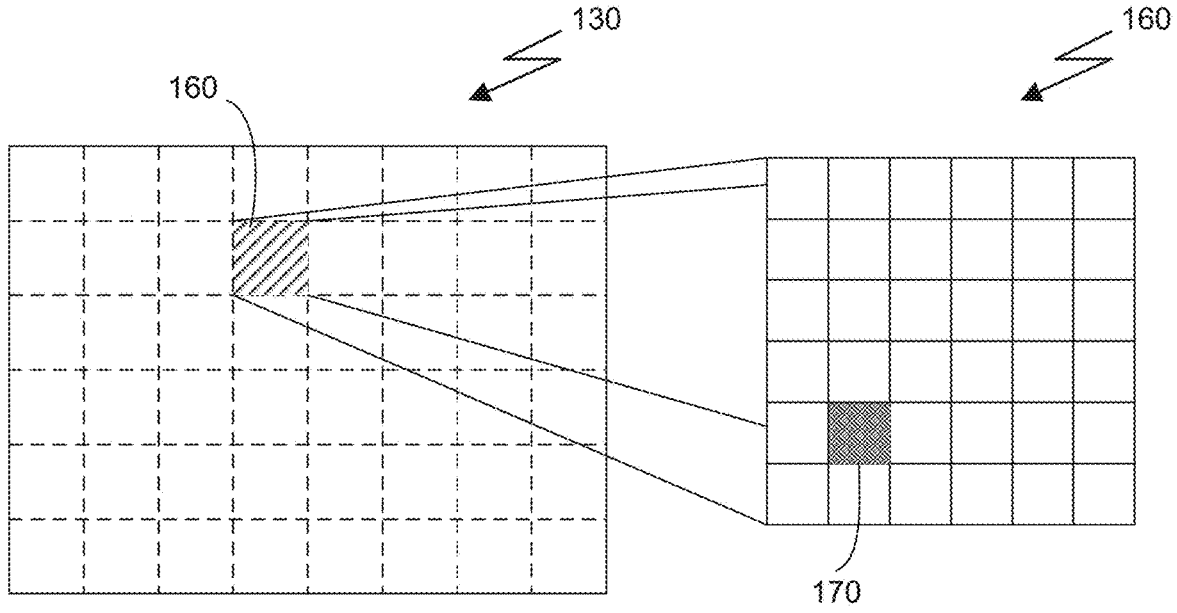
FIG. 1B illustrates an example of the SLM, in accordance with some embodiments.

FIG. 1B illustrates an example of the SLM 130, in accordance with some embodiments. In an embodiment, the SLM 130 has a resolution of, e.g., 320×240 pixels 170, where each pixel 170 comprises at least one light-modulating element. The SLM 130 can be divided into tiles 160, where each tile 160 has a size of m×n pixels 170. As depicted in FIG. 1B, the SLM 130 is divided into 8×6 tiles, where each tile has 40×60 pixels 170 (not all pixels are shown in the expanded representation of tile 160 in FIG. 1B). However, in other embodiments, the resolution of the SLM 130 and/or the size of tiles may be adjusted compared to the example shown in FIG. 1B, such as having 10×10 pixel tiles 160 or a higher resolution SLM 130, and that the example shown for illustration is not intended to limit the embodiments described herein.

In an embodiment, each pixel 170 comprises a plurality of light-modulating elements associated with different color filters of a color filter array. For example, a pixel 170 of the SLM 130 can include a 2×2 array of light-modulating elements associated with a Bayer color filter array that includes one element overlaid by a red color filter, one element overlaid by a blue color filter, and two elements overlaid by a green color filter. In other embodiments, a pixel 170 includes a single monochromatic light-modulating element without a color filter. In yet other embodiments, a pixel 170 can be associated with different color filters such as a RGBE filter, a CYGM filter, or the like. The number of color filters in the color filter array typically corresponds with the number of color channels in the target image frame.

It will be appreciated that the backlight signal 102 is modulated at significantly faster frequencies than the modulating signal 104, relative to each light-emitting element or light-modulating element, respectively. In other words, while the light-modulating elements of the SLM 130 are updated at a refresh frequency of, e.g., 30-120 Hz, the light-emitting elements of the backlight 120 are updated at frequencies of tens to hundreds of times faster (e.g., 500 Hz-100 kHz). In operation, the light modulating elements of the SLM 130 are updated once per frame period to tile a number of image patches on the SLM 130 for a single target image frame while the light-emitting element(s) of the backlight 120 are turned on or off (i.e., activated or deactivated) a number of times during the frame period. Similarly, the optical scanning device 140 is adjusted at a continuous rate or at a frequency that matches the backlight signal 102 such that the location of the projected image on the projection surface changes during the frame period.

The additive nature of incoherent light sources means that, in order to reconstruct the target image frame on the projection surface, the controller 110 must decompose the target image frame into a set of N image patches corresponding to the number of tiles of the SLM 130. In some embodiments, the decomposition model is a modified projective non-negative matrix factorization (P-NMF) model. In other embodiments, the decomposition model is a truncated version of singular value decomposition (t-SVD).

More specifically, a model for defining the reconstructed image on the projection surface is given in Equation 1 as:

$$R(x,y)=\Sigma_{t=t_0}^{t_n}T(M_p,t)=\Sigma_{t=t_0}^{t_n}T((O_t\lfloor S_t),t), \quad \text{(Eq. 1)}$$

where R represents the reconstructed image over time, O represents a binary three-channel backlight signal, S represents a three-channel modulation signal, M represents element-wise multiplication of S and O, and T represents the transformation in accordance with the scan trajectory.

The model should also account for the HVS and how the viewer will perceive the sub-frames of the projected image displayed at each time step. More specifically, studies suggest that there are three causes for visual stimuli to persist and slowly decay including: photoreceptor bleaching and regeneration, fast neural adaptation, and slow neural adaptation. The first factor is a slow process (on the order of hundreds of seconds), and of the remaining two factors, fast neural adaptation is more relevant to the operation of a PDS. Fast neural adaptation can be modeled using an exponential decay function given in Equation 2 as:

$$F(t) = I_t(t)\left(1 - e^{\frac{\Delta t}{\tau}}\right), \quad \text{(Eq. 2)}$$

where $I_t(t)$ represents a time varying light source input, $\Delta t$ represents a discrete time step, and $\tau$ represents a time constant for a photoreceptor (e.g., a rod or a cone). Although the time constant for rods and cones can vary, and not all individuals may have photoreceptors that behave identically, a time constant of approximately $\tau$=80 ms appears to work well for all regions of a reconstructed image.

Applying this concept of exponential decay to the model in Equation 1 yields:

$$R(x, y) = \sum_{t=t_0}^{t_n} T((O_t \odot S_t),\ t)\left(1 - e^{\frac{t_n - t}{\tau}}\right), \quad \text{(Eq. 3)}$$

Given the above reconstructed image model of Equation 3, the controller 110 is configured to generate a set of N image patches based on basis functions calculated during decomposition of the target image frame. A target image frame I(x, y, i) is received with k columns, l rows, and i color channels. In many cases, the target image frame is provided as a RGB image such that i=3. In an optional pre-processing step, the target image frame can be resized such that the dimensions of k×l matches the native resolution of the SLM 130. We will assume that the number of pixels of the SLM 130 is equal to k×l such that no resizing is necessary.

In a first step of the P-NMF decomposition, the target image frame is transformed using transformation T for each discrete time step across the scan trajectory. For example, assume a scan trajectory over a frame period corresponding to 60 frames per second (e.g., 60 Hz) is divided into 100 discrete time steps. The frame period would be equal to 16.66 milliseconds (ms), but each discrete time step would correspond to 166.66 microseconds (μs). In addition, the location of the projected image would move every 166.66 μs, and the light-emitting elements of the backlight 120 would also be updated every 166.66 μs. Because the transformation T varies in time, the transformed image T(I(x, y)) at each time step can be different. In other words, the value of T(I(x, y)) for a given pixel position (x, y) changes over time. The different versions of the transformed target image frame can be computed in parallel by applying different affine transformations to the target image frame, which is simply a matrix multiplication operation. In a simple case, the scan trajectory is a translation in x and y dimensions and, therefore, the transformation is simply a translation of the target image frame from an initial location to a different location along the scan trajectory. In a more complex case, the scan trajectory can include a rotation of the target image frame.

Beginning at a first time step ($t=t_0$), a first version of the transformed image is split into each color channel. Each channel of the transformed image is vectorized by dividing the transformed image into image tiles of dimension M=m×n pixels, which are scanned out in row major order to generate columns of the vectorized matrix V with dimensions N×M. The controller 110 searches for a solution to minimize the Euclidean distance according to the following equation:

$$\underset{W \geq 0}{argmin} \|V - WW^T V\|, \quad \text{(Eq. 4)}$$

where the Euclidean distance is a matrix norm $\|\cdot\|$, W represents an orthogonal non-negative matrix with dimensions M×r having vectorized basis functions and rank r. In other words, each column of W represents a basis function. The rank r can be selected and, in some embodiments, can be set equal to 16. The Euclidean distance between two sample matrices of A and B is calculated as follows:

$$\|A-B\|^2=\Sigma_{x,y}(A_{xy}-B_{xy})^2 \quad \text{(Eq. 5)}$$

Using the Euclidean distance matrix norm defined in Equation 5, the matrix W can be calculated iteratively by initializing $W_{xy}$ with random positive values and then updating the matrix for each transformed image at a plurality of time steps using a multiplicative update rule as follows:

$$W_{xy} \leftarrow W_{xy} \frac{(VV^TW)_{xy}}{(WW^TVV^TW)_{xy} - (VV^TWW^TW)_{xy}} \quad \text{(Eq. 6)}$$

After a number of time steps, the matrix W will converge to solve the problem of Equation 4, and each column of W represents a basis function. It will be appreciated that the number of basis functions does not necessarily equal the number of image patches N to tile over the SLM 130. The number r of basis functions is a configurable parameter of the system. In exemplary embodiments, setting the parameter r equal to 64 (i.e., generating 64 basis functions for each color component) is sufficient to produce equivalent results to conventional JPEG compression. Increasing r can result in better image quality of the reconstructed image, but comes at the cost of increased computational complexity.

Once the set of N image patches for the target image frame are generated, then the backlight signal is calculated. Again, each light-emitting element is controlled via binary control (either on or off) at each time step during a frame period. Consequently, for each time step, the controller 110 calculates a residual image $J_t$ based on the difference between the target image frame $I_t$ and a reconstructed image $R_t$ given in equation 3 from $t=t_0$ to the current time step, as follows:

$$J_t(x,y)=I(x,y)-R_t(x,y), \quad \text{(Eq. 7)}$$

where I represents the target image frame and $R_t$ represents the reconstructed image at a given time step t for a given set of $O_t$ and $S_t$. The value of $O_t$ at each time step can be calculated as follows:

$$O_t(x, y) = \begin{cases} \text{if } J_t(x, y) \geq 0 & 1 \\ \text{if } J_t(x, y) < 0 & 0 \end{cases}, \quad \text{(Eq. 8)}$$

In other words, if the reconstructed pixel value is less than the corresponding pixel value in the target image frame, turn on the backlight during this time step to increase the intensity of the perceived pixel value at the pixel location. However, if the reconstructed pixel value is greater than the corresponding pixel value in the target image frame, turn off the backlight during this time step to decrease the intensity of the perceived pixel value at the pixel location. It will be appreciated that, in some embodiments, each light-emitting element of the backlight 120 can correspond to more than one light-modulating element of the SLM 130. In such cases, Equation 8 can be modified to compare the sum of $J_t(x,y)$ over all pixel locations corresponding to that light-emitting element to zero.

In some embodiments, the backlight signal $O_t$ is generated for each time step t by choosing the time step t randomly rather than moving sequentially from $t_0$ to $t_n$. As $O_t$ is calculated, a next time step t is chosen randomly to randomize any noise patterns in the image reconstruction for each target image frame.

Figure 2:
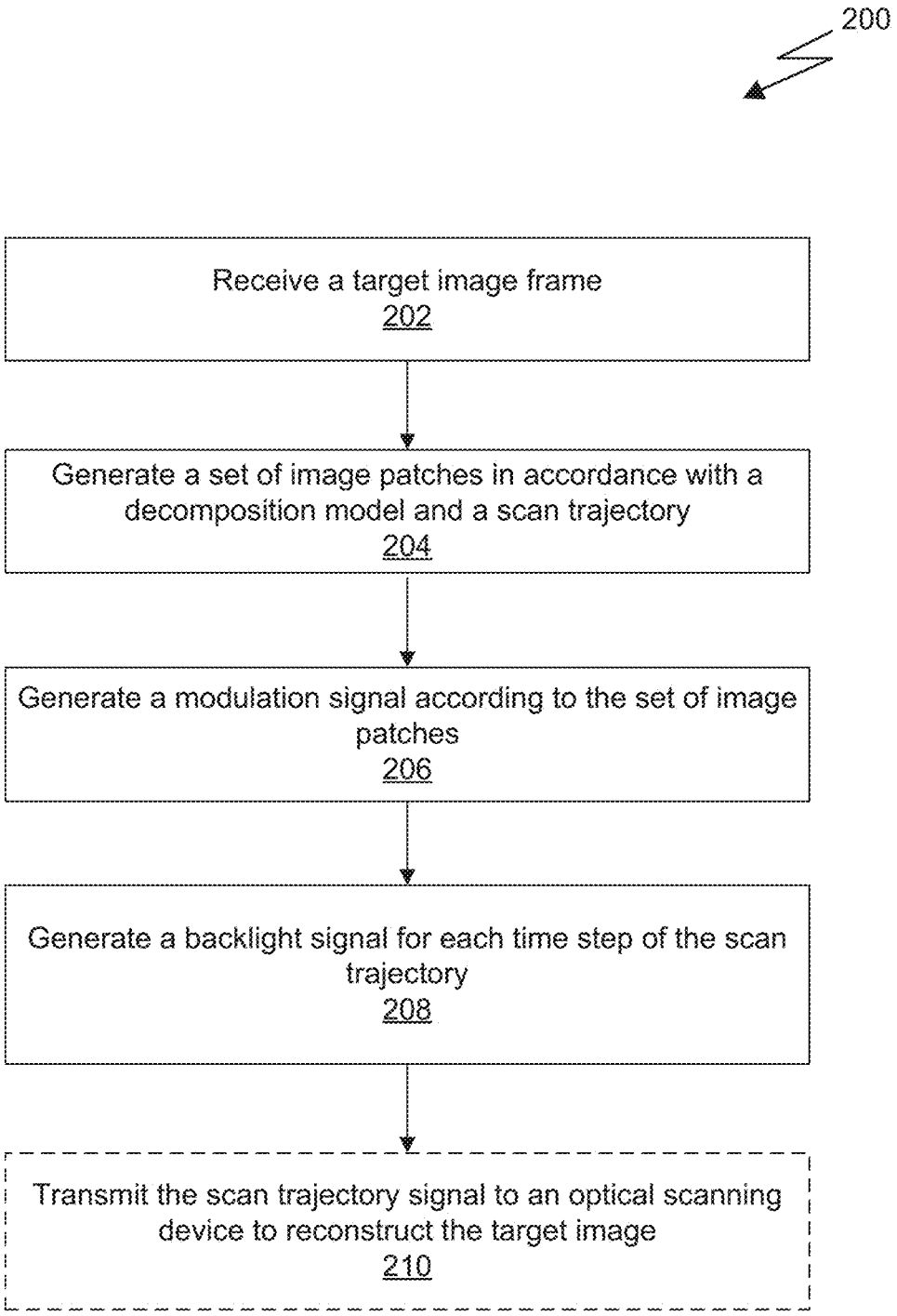
FIG. 2 is a flow chart of a method that illustrates steps for implementing the patch scanning technique, in accordance with some embodiments.

FIG. 2 is a flow chart of a method 200 that illustrates steps for implementing the patch scanning technique, in accordance with some embodiments. The steps set forth below are described with the understanding that the steps are implemented as computer program instructions executed by a processor such as controller 110 of FIG. 1A. However, one of skill in the art will recognize that the method 200 can be performed by software, hardware, or a combination of software and hardware, in various embodiments. Any system that performs the steps of method 200 is contemplated as being within the scope of the following disclosure.

At step 202, a target image frame is received. In some embodiments, the target image is a two-dimensional array of pixel values provided with k columns, l rows, and i color channels. For instance, i=1 for a monochromatic image, and i=3 for a multi-color image having red, green, and blue color channels.

At step 204, a set of image patches corresponding to the target image frame are generated in accordance with a decomposition model and a scan trajectory. In some embodiments, a projective non-negative matrix factorization (P-NMF) model is utilized in a computational approach to determine a set of N image patches, where N is a non-negative integer and multiple (i.e., greater than 1). Each image patch includes m rows and n columns of pixels that can be tiled onto an SLM 130 side by side. For example, in some embodiments, an image patch has a size of m×n=6×6. The size of an image patch and the number of image patches can affect the quality of the reconstructed image and the time consumed to generate the set of image patches. In other embodiments, a truncated single value decomposition (t-SVD) model is utilized in a computational approach to determine a set of N image patches.

In an embodiment, the P-NMF model is utilized to generate the set of image patches by, for each color channel of the target image frame, generating an input data matrix V for each time step of the scan trajectory by vectorising a plurality of image tiles of a transformed version of the target image frame corresponding to the time step of the scan trajectory. The result is a set of input data matrices, for each color channel of the target image frame, where the number of input data matrices in the set corresponds to the number of discrete time steps of the scan trajectory in the frame period. The set of input data matrices are then used to determine a plurality of basis functions using the P-NMF model. In an embodiment, a matrix W is initialized with random values. Then, for each time step in a number of time steps, the matrix W is updated according to a multiplicative update rule given by Equation 6, set forth above. Once the matrix W converges to solve the optimization problem of Equation 1, the plurality of basis functions represented by the columns of matrix W are transformed into image patches for the color channel and the image patches for each color channel are superimposed to generate the set of image patches used to generate the modulation signal.

At step 206, a modulation signal is generated according to the set of image patches. The modulation signal encodes the pixel values for each image patch in the set of image patches for display, in a tiled manner, on the SLM 130 for the duration of a frame period.

At step 208, a backlight signal is generated for each time step of the scan trajectory. In an embodiment, for each time step of the scan trajectory, a binary value for each light-emitting element of the backlight 120 is determined by calculating a difference between the target image frame and a reconstructed image at one or more locations corresponding to the light-emitting element. The reconstructed image at a particular time step can be determined in accordance with Equation 3, set forth above.

In some embodiments, the backlight signal 102 is generated as binary levels to activate or deactivate light-emitting element(s) in the backlight 120 following a certain sequence to match the scan trajectory of the optical scanning device 140. The binary rate of updating the light-emitting elements is of a high refresh rate (e.g., tens or hundreds of kilohertz). The refresh rate of light-emitting elements in the backlight 120 is much faster than a refresh rate of light-modulating elements of the SLM 130.

At step 208, the modulation signal is transmitted to the SLM 130 and the backlight signal is transmitted to the backlight 120, which project a reconstructed version of the target image frame on a projection surface. In some embodiments, the projection surface is a flat surface within line-of-sight of a viewer. In other embodiments, the projection surface is a retina of a user's eye.

At step 210 a scan trajectory signal is transmitted to the optical scanning device 140. The scan trajectory signal causes the optical scanning device 140 to scan the image projected through the SLM 130 on the projection surface in accordance with the scan trajectory signal. In some embodiments, the scan trajectory signal 106 is manually pre-configured to adapt the optical scanning device 140 to move in a pre-determined trajectory. In other embodiments, the scan trajectory signal 106 is dynamic and can be adjusted by the controller 110 in accordance with some criteria. For example, the scan trajectory signal 106 can be manually or automatically selected from one of a plurality of suitable scan trajectory signals corresponding to different scan trajectories, such as traditional scanline order or spiral trajectories.

It will be appreciated that, in some embodiments, step 210 can be optional. In some embodiments, the optical scanning device 140 is pre-configured with a scan trajectory without receiving a scan trajectory signal 106 from the controller 110. The optical scanning device 140 follows a certain scan trajectory and projects the image projected by the SLM 130 on varying locations of the projection surface. A single frame of the reconstructed target image is formed when the optical scanning device 140 completes a full scan trajectory over the frame period.

More illustrative information will now be set forth regarding various optional architectures and features with which the foregoing framework may be implemented, per the desires of the user. It should be strongly noted that the following information is set forth for illustrative purposes and should not be construed as limiting in any manner. Any of the following features may be optionally incorporated with or without the exclusion of other features described.

Although the system 100 is described in the context of a controller 110, the controller 110 may be implemented as a program, custom circuitry, or by a combination of custom circuitry and a program. For example, the functionality of the controller 110 may be implemented by a GPU (graphics processing unit), CPU (central processing unit), or any processor capable of implementing the functionality set forth above. Furthermore, persons of ordinary skill in the art will understand that any system that performs the operations of the system 100 is within the scope and spirit of embodiments of the present disclosure. An exemplary embodiment of a parallel processing unit (PPU) utilized to implement at least a portion of the controller 110 is set forth below.

Parallel Processing Architecture

Figure 3:
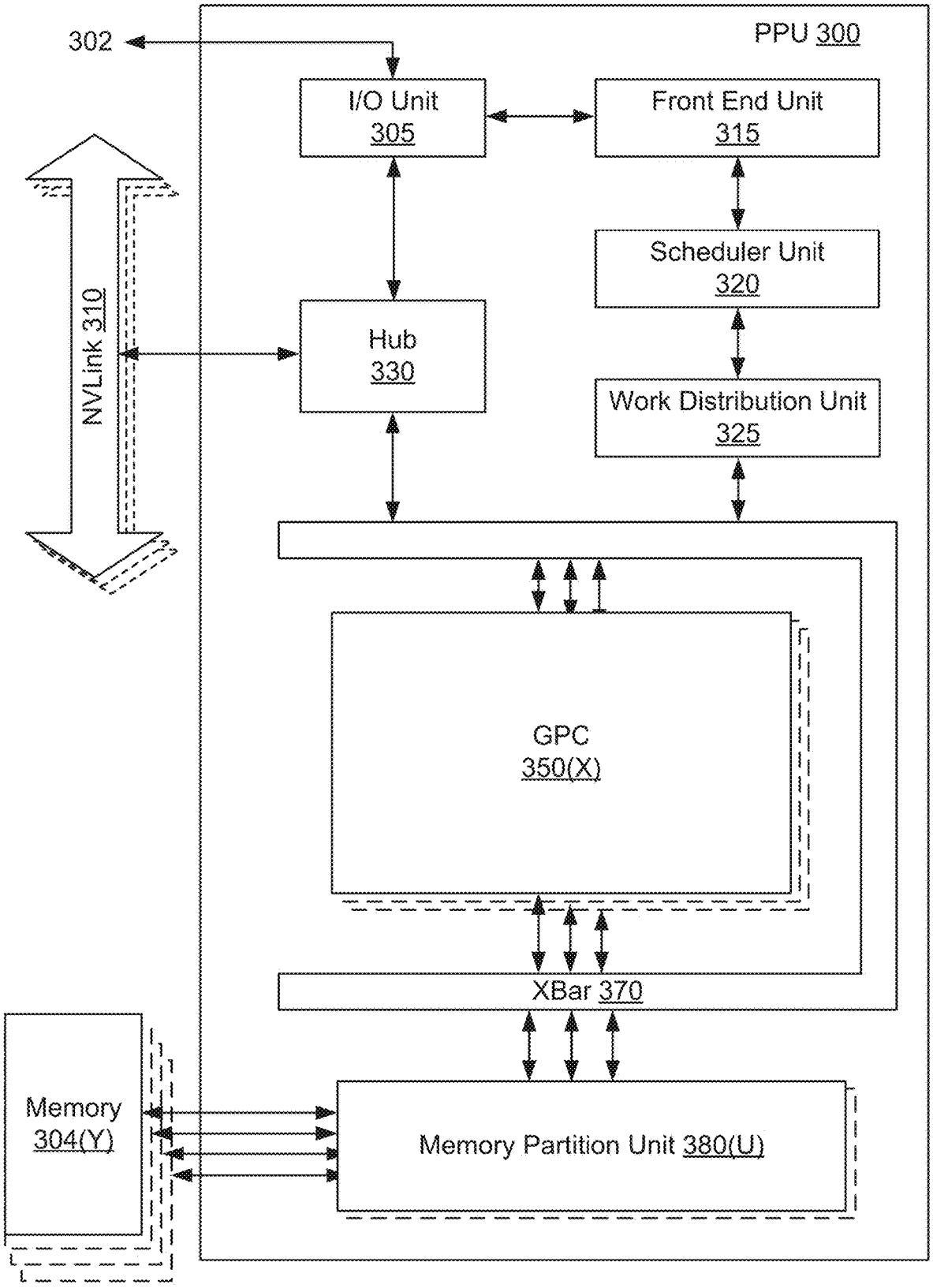
FIG. 3 illustrates a parallel processing unit, in accordance with an embodiment.

FIG. 3 illustrates a parallel processing unit (PPU) 300, in accordance with an embodiment. In an embodiment, the PPU 300 is a multi-threaded processor that is implemented on one or more integrated circuit devices. The PPU 300 is a latency hiding architecture designed to process many threads in parallel. A thread (e.g., a thread of execution) is an instantiation of a set of instructions configured to be executed by the PPU 300. In an embodiment, the PPU 300 is a graphics processing unit (GPU) configured to implement a graphics rendering pipeline for processing three-dimensional (3D) graphics data in order to generate two-dimensional (2D) image data for display on a display device such as a liquid crystal display (LCD) device. In other embodiments, the PPU 300 may be utilized for performing general-purpose computations. While one exemplary parallel processor is provided herein for illustrative purposes, it should be strongly noted that such processor is set forth for illustrative purposes only, and that any processor may be employed to supplement and/or substitute for the same.

One or more PPUs 300 may be configured to accelerate thousands of High Performance Computing (HPC), data center, and machine learning applications. The PPU 300 may be configured to accelerate numerous deep learning systems and applications including autonomous vehicle platforms, deep learning, high-accuracy speech, image, and text recognition systems, intelligent video analytics, molecular simulations, drug discovery, disease diagnosis, weather forecasting, big data analytics, astronomy, molecular dynamics simulation, financial modeling, robotics, factory automation, real-time language translation, online search optimizations, and personalized user recommendations, and the like.

As shown in FIG. 3, the PPU 300 includes an Input/Output (I/O) unit 305, a front end unit 315, a scheduler unit 320, a work distribution unit 325, a hub 330, a crossbar (Xbar) 370, one or more general processing clusters (GPCs) 350, and one or more memory partition units 380. The PPU 300 may be connected to a host processor or other PPUs 300 via one or more high-speed NVLink 310 interconnect. The PPU 300 may be connected to a host processor or other peripheral devices via an interconnect 302. The PPU 300 may also be connected to a local memory 304 comprising a number of memory devices. In an embodiment, the local memory may comprise a number of dynamic random access memory (DRAM) devices. The DRAM devices may be configured as a high-bandwidth memory (HBM) subsystem, with multiple DRAM dies stacked within each device.

The NVLink 310 interconnect enables systems to scale and include one or more PPUs 300 combined with one or more CPUs, supports cache coherence between the PPUs 300 and CPUs, and CPU mastering. Data and/or commands may be transmitted by the NVLink 310 through the hub 330 to/from other units of the PPU 300 such as one or more copy engines, a video encoder, a video decoder, a power management unit, etc. (not explicitly shown). The NVLink 310 is described in more detail in conjunction with FIG. 5B.

The I/O unit 305 is configured to transmit and receive communications (e.g., commands, data, etc.) from a host processor (not shown) over the interconnect 302. The I/O unit 305 may communicate with the host processor directly via the interconnect 302 or through one or more intermediate devices such as a memory bridge. In an embodiment, the I/O unit 305 may communicate with one or more other processors, such as one or more the PPUs 300 via the interconnect 302. In an embodiment, the I/O unit 305 implements a Peripheral Component Interconnect Express (PCIe) interface for communications over a PCIe bus and the interconnect 302 is a PCIe bus. In alternative embodiments, the I/O unit 305 may implement other types of well-known interfaces for communicating with external devices.

The I/O unit 305 decodes packets received via the interconnect 302. In an embodiment, the packets represent commands configured to cause the PPU 300 to perform various operations. The I/O unit 305 transmits the decoded commands to various other units of the PPU 300 as the commands may specify. For example, some commands may be transmitted to the front end unit 315. Other commands may be transmitted to the hub 330 or other units of the PPU 300 such as one or more copy engines, a video encoder, a video decoder, a power management unit, etc. (not explicitly shown). In other words, the I/O unit 305 is configured to route communications between and among the various logical units of the PPU 300.

In an embodiment, a program executed by the host processor encodes a command stream in a buffer that provides workloads to the PPU 300 for processing. A workload may comprise several instructions and data to be processed by those instructions. The buffer is a region in a memory that is accessible (e.g., read/write) by both the host processor and the PPU 300. For example, the I/O unit 305 may be configured to access the buffer in a system memory connected to the interconnect 302 via memory requests transmitted over the interconnect 302. In an embodiment, the host processor writes the command stream to the buffer and then transmits a pointer to the start of the command stream to the PPU 300. The front end unit 315 receives pointers to one or more command streams. The front end unit 315 manages the one or more streams, reading commands from the streams and forwarding commands to the various units of the PPU 300.

The front end unit 315 is coupled to a scheduler unit 320 that configures the various GPCs 350 to process tasks defined by the one or more streams. The scheduler unit 320 is configured to track state information related to the various tasks managed by the scheduler unit 320. The state may indicate which GPC 350 a task is assigned to, whether the task is active or inactive, a priority level associated with the task, and so forth. The scheduler unit 320 manages the execution of a plurality of tasks on the one or more GPCs 350.

The scheduler unit 320 is coupled to a work distribution unit 325 that is configured to dispatch tasks for execution on the GPCs 350. The work distribution unit 325 may track a number of scheduled tasks received from the scheduler unit 320. In an embodiment, the work distribution unit 325 manages a pending task pool and an active task pool for each of the GPCs 350. The pending task pool may comprise a number of slots (e.g., 32 slots) that contain tasks assigned to be processed by a particular GPC 350. The active task pool may comprise a number of slots (e.g., 4 slots) for tasks that are actively being processed by the GPCs 350. As a GPC 350 finishes the execution of a task, that task is evicted from the active task pool for the GPC 350 and one of the other tasks from the pending task pool is selected and scheduled for execution on the GPC 350. If an active task has been idle on the GPC 350, such as while waiting for a data dependency to be resolved, then the active task may be evicted from the GPC 350 and returned to the pending task pool while another task in the pending task pool is selected and scheduled for execution on the GPC 350.

The work distribution unit 325 communicates with the one or more GPCs 350 via XBar 370. The XBar 370 is an interconnect network that couples many of the units of the PPU 300 to other units of the PPU 300. For example, the XBar 370 may be configured to couple the work distribution unit 325 to a particular GPC 350. Although not shown explicitly, one or more other units of the PPU 300 may also be connected to the XBar 370 via the hub 330.

The tasks are managed by the scheduler unit 320 and dispatched to a GPC 350 by the work distribution unit 325. The GPC 350 is configured to process the task and generate results. The results may be consumed by other tasks within the GPC 350, routed to a different GPC 350 via the XBar 370, or stored in the memory 304. The results can be written to the memory 304 via the memory partition units 380, which implement a memory interface for reading and writing data to/from the memory 304. The results can be transmitted to another PPU 300 or CPU via the NVLink 310. In an embodiment, the PPU 300 includes a number U of memory partition units 380 that is equal to the number of separate and distinct memory devices of the memory 304 coupled to the PPU 300. A memory partition unit 380 will be described in more detail below in conjunction with FIG. 4B.

In an embodiment, a host processor executes a driver kernel that implements an application programming interface (API) that enables one or more applications executing on the host processor to schedule operations for execution on the PPU 300. In an embodiment, multiple compute applications are simultaneously executed by the PPU 300 and the PPU 300 provides isolation, quality of service (QoS), and independent address spaces for the multiple compute applications. An application may generate instructions (e.g., API calls) that cause the driver kernel to generate one or more tasks for execution by the PPU 300. The driver kernel outputs tasks to one or more streams being processed by the PPU 300. Each task may comprise one or more groups of related threads, referred to herein as a warp. In an embodiment, a warp comprises 32 related threads that may be executed in parallel. Cooperating threads may refer to a plurality of threads including instructions to perform the task and that may exchange data through shared memory. Threads and cooperating threads are described in more detail in conjunction with FIG. 5A.

Figure 4A:
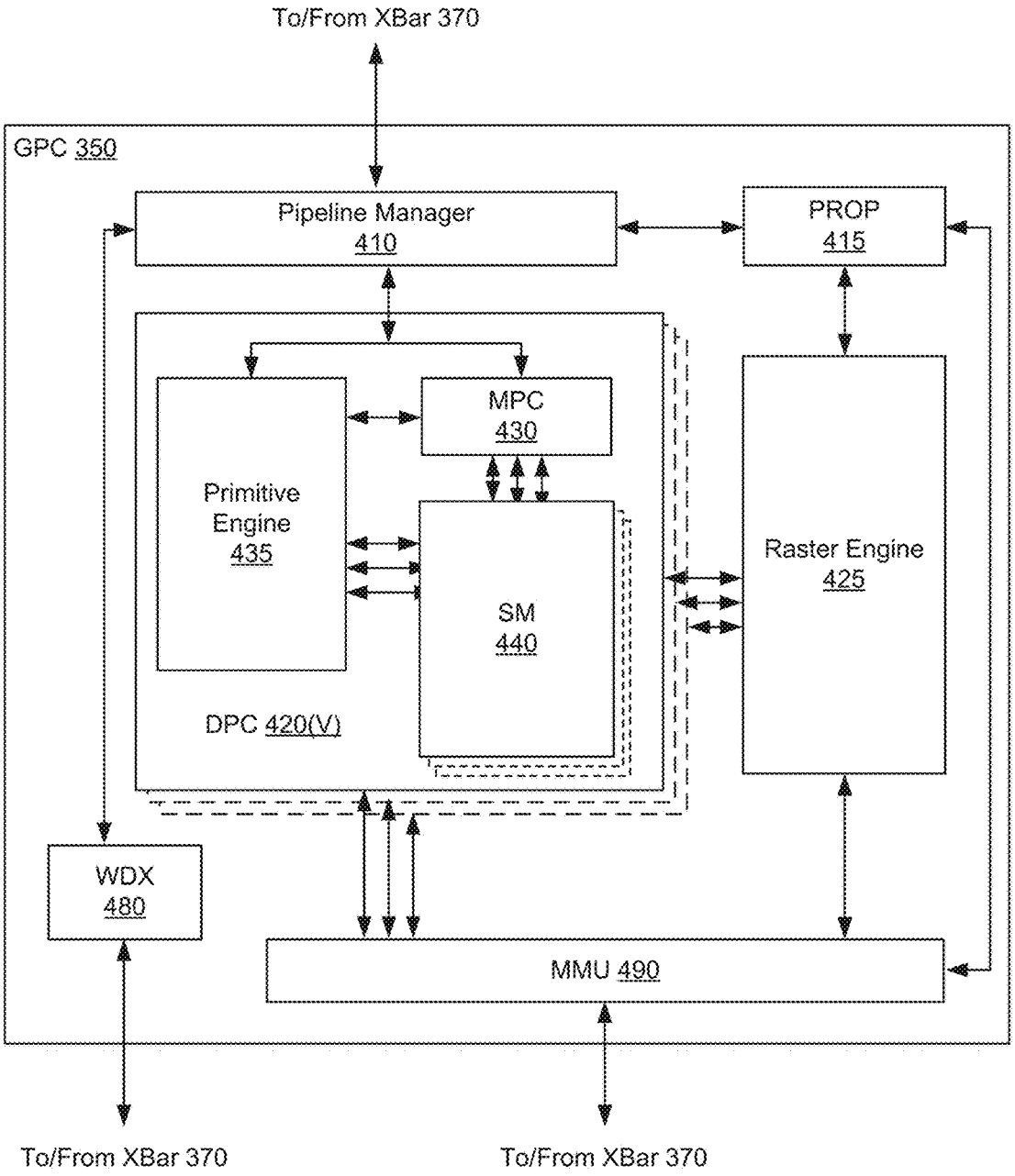
FIG. 4A illustrates a general processing cluster within the parallel processing unit of FIG. 3, in accordance with an embodiment.

FIG. 4A illustrates a GPC 350 of the PPU 300 of FIG. 3, in accordance with an embodiment. As shown in FIG. 4A, each GPC 350 includes a number of hardware units for processing tasks. In an embodiment, each GPC 350 includes a pipeline manager 410, a pre-raster operations unit (PROP) 415, a raster engine 425, a work distribution crossbar (WDX) 480, a memory management unit (MMU) 490, and one or more Data Processing Clusters (DPCs) 420. It will be appreciated that the GPC 350 of FIG. 4A may include other hardware units in lieu of or in addition to the units shown in FIG. 4A.

In an embodiment, the operation of the GPC 350 is controlled by the pipeline manager 410. The pipeline manager 410 manages the configuration of the one or more DPCs 420 for processing tasks allocated to the GPC 350. In an embodiment, the pipeline manager 410 may configure at least one of the one or more DPCs 420 to implement at least a portion of a graphics rendering pipeline. For example, a DPC 420 may be configured to execute a vertex shader program on the programmable streaming multiprocessor (SM) 440. The pipeline manager 410 may also be configured to route packets received from the work distribution unit 325 to the appropriate logical units within the GPC 350. For example, some packets may be routed to fixed function hardware units in the PROP 415 and/or raster engine 425 while other packets may be routed to the DPCs 420 for processing by the primitive engine 435 or the SM 440. In an embodiment, the pipeline manager 410 may configure at least one of the one or more DPCs 420 to implement a neural network model and/or a computing pipeline.

Figure 4B:
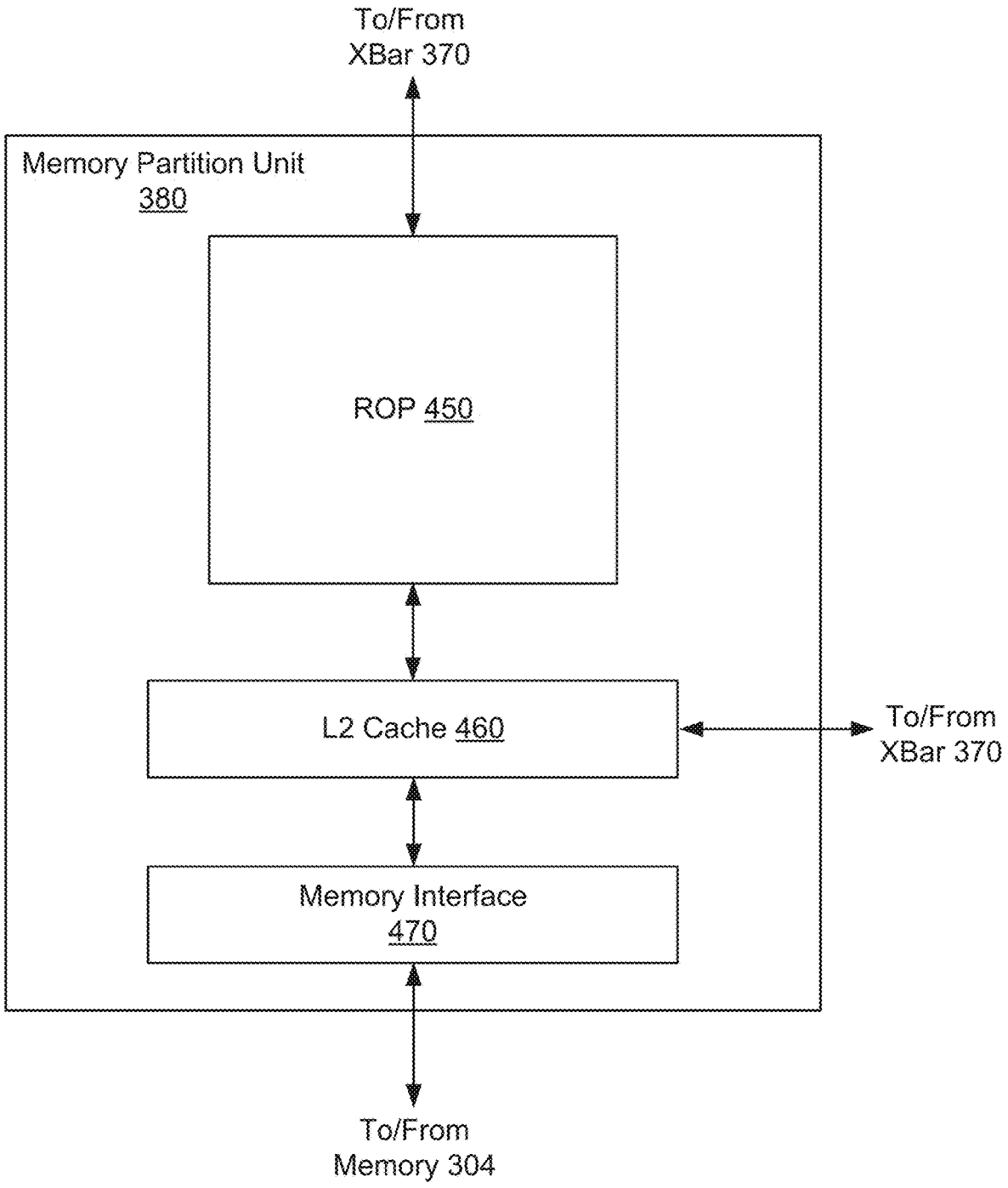
FIG. 4B illustrates a memory partition unit of the parallel processing unit of FIG. 3, in accordance with an embodiment.

The PROP unit 415 is configured to route data generated by the raster engine 425 and the DPCs 420 to a Raster Operations (ROP) unit, described in more detail in conjunction with FIG. 4B. The PROP unit 415 may also be configured to perform optimizations for color blending, organize pixel data, perform address translations, and the like.

The raster engine 425 includes a number of fixed function hardware units configured to perform various raster operations. In an embodiment, the raster engine 425 includes a setup engine, a coarse raster engine, a culling engine, a clipping engine, a fine raster engine, and a tile coalescing engine. The setup engine receives transformed vertices and generates plane equations associated with the geometric primitive defined by the vertices. The plane equations are transmitted to the coarse raster engine to generate coverage information (e.g., an x,y coverage mask for a tile) for the primitive. The output of the coarse raster engine is transmitted to the culling engine where fragments associated with the primitive that fail a z-test are culled, and transmitted to a clipping engine where fragments lying outside a viewing frustum are clipped. Those fragments that survive clipping and culling may be passed to the fine raster engine to generate attributes for the pixel fragments based on the plane equations generated by the setup engine. The output of the raster engine 425 comprises fragments to be processed, for example, by a fragment shader implemented within a DPC 420.

Each DPC 420 included in the GPC 350 includes an M-Pipe Controller (MPC) 430, a primitive engine 435, and one or more SMs 440. The MPC 430 controls the operation of the DPC 420, routing packets received from the pipeline manager 410 to the appropriate units in the DPC 420. For example, packets associated with a vertex may be routed to the primitive engine 435, which is configured to fetch vertex attributes associated with the vertex from the memory 304. In contrast, packets associated with a shader program may be transmitted to the SM 440.

The SM 440 comprises a programmable streaming processor that is configured to process tasks represented by a number of threads. Each SM 440 is multi-threaded and configured to execute a plurality of threads (e.g., 32 threads) from a particular group of threads concurrently. In an embodiment, the SM 440 implements a SIMD (Single-Instruction, Multiple-Data) architecture where each thread in a group of threads (e.g., a warp) is configured to process a different set of data based on the same set of instructions. All threads in the group of threads execute the same instructions. In another embodiment, the SM 440 implements a SIMT (Single-Instruction, Multiple Thread) architecture where each thread in a group of threads is configured to process a different set of data based on the same set of instructions, but where individual threads in the group of threads are allowed to diverge during execution. In an embodiment, a program counter, call stack, and execution state is maintained for each warp, enabling concurrency between warps and serial execution within warps when threads within the warp diverge. In another embodiment, a program counter, call stack, and execution state is maintained for each individual thread, enabling equal concurrency between all threads, within and between warps. When execution state is maintained for each individual thread, threads executing the same instructions may be converged and executed in parallel for maximum efficiency. The SM 440 will be described in more detail below in conjunction with FIG. 5A.

The MMU 490 provides an interface between the GPC 350 and the memory partition unit 380. The MMU 490 may provide translation of virtual addresses into physical addresses, memory protection, and arbitration of memory requests. In an embodiment, the MMU 490 provides one or more translation lookaside buffers (TLBs) for performing translation of virtual addresses into physical addresses in the memory 304.

FIG. 4B illustrates a memory partition unit 380 of the PPU 300 of FIG. 3, in accordance with an embodiment. As shown in FIG. 4B, the memory partition unit 380 includes a Raster Operations (ROP) unit 450, a level two (L2) cache 460, and a memory interface 470. The memory interface 470 is coupled to the memory 304. Memory interface 470 may implement 32, 64, 128, 1024-bit data buses, or the like, for high-speed data transfer. In an embodiment, the PPU 300 incorporates U memory interfaces 470, one memory interface 470 per pair of memory partition units 380, where each pair of memory partition units 380 is connected to a corresponding memory device of the memory 304. For example, PPU 300 may be connected to up to Y memory devices, such as high bandwidth memory stacks or graphics double-data-rate, version 5, synchronous dynamic random access memory, or other types of persistent storage.

In an embodiment, the memory interface 470 implements an HBM2 memory interface and Y equals half U. In an embodiment, the HBM2 memory stacks are located on the same physical package as the PPU 300, providing substantial power and area savings compared with conventional GDDR5 SDRAM systems. In an embodiment, each HBM2 stack includes four memory dies and Y equals 4, with HBM2 stack including two 128-bit channels per die for a total of 8 channels and a data bus width of 1024 bits.

In an embodiment, the memory 304 supports Single-Error Correcting Double-Error Detecting (SECDED) Error Correction Code (ECC) to protect data. ECC provides higher reliability for compute applications that are sensitive to data corruption. Reliability is especially important in large-scale cluster computing environments where PPUs 300 process very large datasets and/or run applications for extended periods.

In an embodiment, the PPU 300 implements a multi-level memory hierarchy. In an embodiment, the memory partition unit 380 supports a unified memory to provide a single unified virtual address space for CPU and PPU 300 memory, enabling data sharing between virtual memory systems. In an embodiment the frequency of accesses by a PPU 300 to memory located on other processors is traced to ensure that memory pages are moved to the physical memory of the PPU 300 that is accessing the pages more frequently. In an embodiment, the NVLink 310 supports address translation services allowing the PPU 300 to directly access a CPU's page tables and providing full access to CPU memory by the PPU 300.

In an embodiment, copy engines transfer data between multiple PPUs 300 or between PPUs 300 and CPUs. The copy engines can generate page faults for addresses that are not mapped into the page tables. The memory partition unit 380 can then service the page faults, mapping the addresses into the page table, after which the copy engine can perform the transfer. In a conventional system, memory is pinned (e.g., non-pageable) for multiple copy engine operations between multiple processors, substantially reducing the available memory. With hardware page faulting, addresses can be passed to the copy engines without worrying if the memory pages are resident, and the copy process is transparent.

Data from the memory 304 or other system memory may be fetched by the memory partition unit 380 and stored in the L2 cache 460, which is located on-chip and is shared between the various GPCs 350. As shown, each memory partition unit 380 includes a portion of the L2 cache 460 associated with a corresponding memory 304. Lower level caches may then be implemented in various units within the GPCs 350. For example, each of the SMs 440 may implement a level one (L1) cache. The L1 cache is private memory that is dedicated to a particular SM 440. Data from the L2 cache 460 may be fetched and stored in each of the L1 caches for processing in the functional units of the SMs 440. The L2 cache 460 is coupled to the memory interface 470 and the XBar 370.

The ROP unit 450 performs graphics raster operations related to pixel color, such as color compression, pixel blending, and the like. The ROP unit 450 also implements depth testing in conjunction with the raster engine 425, receiving a depth for a sample location associated with a pixel fragment from the culling engine of the raster engine 425. The depth is tested against a corresponding depth in a depth buffer for a sample location associated with the fragment. If the fragment passes the depth test for the sample location, then the ROP unit 450 updates the depth buffer and transmits a result of the depth test to the raster engine 425. It will be appreciated that the number of memory partition units 380 may be different than the number of GPCs 350 and, therefore, each ROP unit 450 may be coupled to each of the GPCs 350. The ROP unit 450 tracks packets received from the different GPCs 350 and determines which GPC 350 that a result generated by the ROP unit 450 is routed to through the Xbar 370. Although the ROP unit 450 is included within the memory partition unit 380 in FIG. 4B, in other embodiment, the ROP unit 450 may be outside of the memory partition unit 380. For example, the ROP unit 450 may reside in the GPC 350 or another unit.

Figure 5A:
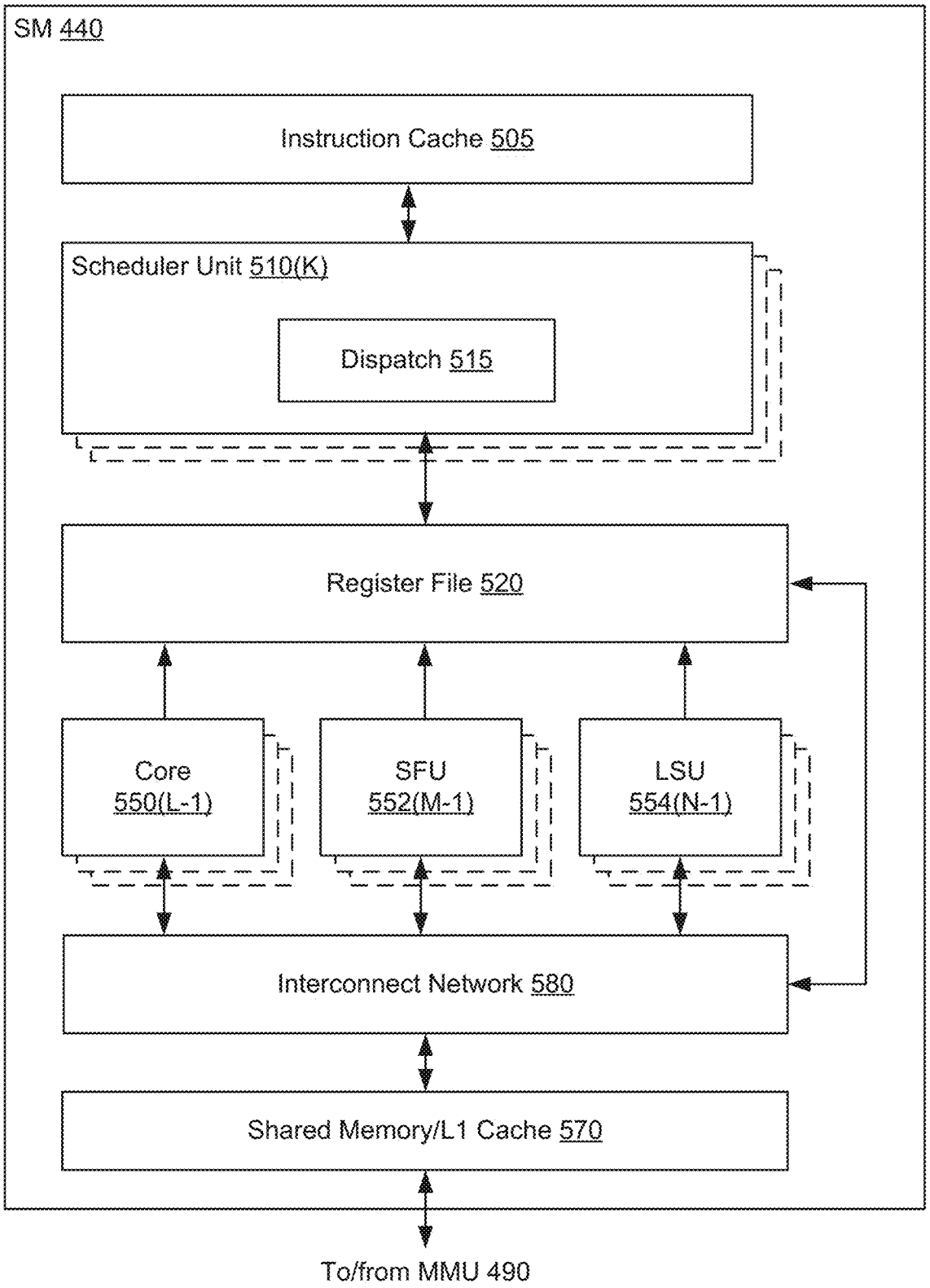
FIG. 5A illustrates the streaming multi-processor of FIG. 4A, in accordance with an embodiment.

FIG. 5A illustrates the streaming multi-processor 440 of FIG. 4A, in accordance with an embodiment. As shown in FIG. 5A, the SM 440 includes an instruction cache 505, one or more scheduler units 510, a register file 520, one or more processing cores 550, one or more special function units (SFUs) 552, one or more load/store units (LSUs) 554, an interconnect network 580, a shared memory/L1 cache 570.

As described above, the work distribution unit 325 dispatches tasks for execution on the GPCs 350 of the PPU 300. The tasks are allocated to a particular DPC 420 within a GPC 350 and, if the task is associated with a shader program, the task may be allocated to an SM 440. The scheduler unit 510 receives the tasks from the work distribution unit 325 and manages instruction scheduling for one or more thread blocks assigned to the SM 440. The scheduler unit 510 schedules thread blocks for execution as warps of parallel threads, where each thread block is allocated at least one warp. In an embodiment, each warp executes 32 threads. The scheduler unit 510 may manage a plurality of different thread blocks, allocating the warps to the different thread blocks and then dispatching instructions from the plurality of different cooperative groups to the various functional units (e.g., cores 550, SFUs 552, and LSUs 554) during each clock cycle.

Cooperative Groups is a programming model for organizing groups of communicating threads that allows developers to express the granularity at which threads are communicating, enabling the expression of richer, more efficient parallel decompositions. Cooperative launch APIs support synchronization amongst thread blocks for the execution of parallel algorithms. Conventional programming models provide a single, simple construct for synchronizing cooperating threads: a barrier across all threads of a thread block (e.g., the syncthreads( ) function). However, programmers would often like to define groups of threads at smaller than thread block granularities and synchronize within the defined groups to enable greater performance, design flexibility, and software reuse in the form of collective group-wide function interfaces.

Cooperative Groups enables programmers to define groups of threads explicitly at sub-block (e.g., as small as a single thread) and multi-block granularities, and to perform collective operations such as synchronization on the threads in a cooperative group. The programming model supports clean composition across software boundaries, so that libraries and utility functions can synchronize safely within their local context without having to make assumptions about convergence. Cooperative Groups primitives enable new patterns of cooperative parallelism, including producer-consumer parallelism, opportunistic parallelism, and global synchronization across an entire grid of thread blocks.

A dispatch unit 515 is configured to transmit instructions to one or more of the functional units. In the embodiment, the scheduler unit 510 includes two dispatch units 515 that enable two different instructions from the same warp to be dispatched during each clock cycle. In alternative embodiments, each scheduler unit 510 may include a single dispatch unit 515 or additional dispatch units 515.

Each SM 440 includes a register file 520 that provides a set of registers for the functional units of the SM 440. In an embodiment, the register file 520 is divided between each of the functional units such that each functional unit is allocated a dedicated portion of the register file 520. In another embodiment, the register file 520 is divided between the different warps being executed by the SM 440. The register file 520 provides temporary storage for operands connected to the data paths of the functional units.

Each SM 440 comprises L processing cores 550. In an embodiment, the SM 440 includes a large number (e.g., 128, etc.) of distinct processing cores 550. Each core 550 may include a fully-pipelined, single-precision, double-precision, and/or mixed precision processing unit that includes a floating point arithmetic logic unit and an integer arithmetic logic unit. In an embodiment, the floating point arithmetic logic units implement the IEEE 754-2008 standard for floating point arithmetic. In an embodiment, the cores 550 include 64 single-precision (32-bit) floating point cores, 64 integer cores, 32 double-precision (64-bit) floating point cores, and 8 tensor cores.

Tensor cores configured to perform matrix operations, and, in an embodiment, one or more tensor cores are included in the cores 550. In particular, the tensor cores are configured to perform deep learning matrix arithmetic, such as convolution operations for neural network training and inferencing. In an embodiment, each tensor core operates on a 4×4 matrix and performs a matrix multiply and accumulate operation $D=A\times B+C$, where A, B, C, and D are 4×4 matrices.

In an embodiment, the matrix multiply inputs A and B are 16-bit floating point matrices, while the accumulation matrices C and D may be 16-bit floating point or 32-bit floating point matrices. Tensor Cores operate on 16-bit floating point input data with 32-bit floating point accumulation. The 16-bit floating point multiply requires 64 operations and results in a full precision product that is then accumulated using 32-bit floating point addition with the other intermediate products for a 4×4×4 matrix multiply. In practice, Tensor Cores are used to perform much larger two-dimensional or higher dimensional matrix operations, built up from these smaller elements. An API, such as CUDA 9 C++ API, exposes specialized matrix load, matrix multiply and accumulate, and matrix store operations to efficiently use Tensor Cores from a CUDA-C++ program. At the CUDA level, the warp-level interface assumes 16×16 size matrices spanning all 32 threads of the warp.

Each SM 440 also comprises M SFUs 552 that perform special functions (e.g., attribute evaluation, reciprocal square root, and the like). In an embodiment, the SFUs 552 may include a tree traversal unit configured to traverse a hierarchical tree data structure. In an embodiment, the SFUs 552 may include texture unit configured to perform texture map filtering operations. In an embodiment, the texture units are configured to load texture maps (e.g., a 2D array of texels) from the memory 304 and sample the texture maps to produce sampled texture values for use in shader programs executed by the SM 440. In an embodiment, the texture maps are stored in the shared memory/L1 cache 470. The texture units implement texture operations such as filtering operations using mip-maps (e.g., texture maps of varying levels of detail). In an embodiment, each SM 340 includes two texture units.

Each SM 440 also comprises NLSUs 554 that implement load and store operations between the shared memory/L1 cache 570 and the register file 520. Each SM 440 includes an interconnect network 580 that connects each of the functional units to the register file 520 and the LSU 554 to the register file 520, shared memory/L1 cache 570. In an embodiment, the interconnect network 580 is a crossbar that can be configured to connect any of the functional units to any of the registers in the register file 520 and connect the LSUs 554 to the register file and memory locations in shared memory/L1 cache 570.

The shared memory/L1 cache 570 is an array of on-chip memory that allows for data storage and communication between the SM 440 and the primitive engine 435 and between threads in the SM 440. In an embodiment, the shared memory/L1 cache 570 comprises 128 KB of storage capacity and is in the path from the SM 440 to the memory partition unit 380. The shared memory/L1 cache 570 can be used to cache reads and writes. One or more of the shared memory/L1 cache 570, L2 cache 460, and memory 304 are backing stores.

Combining data cache and shared memory functionality into a single memory block provides the best overall performance for both types of memory accesses. The capacity is usable as a cache by programs that do not use shared memory. For example, if shared memory is configured to use half of the capacity, texture and load/store operations can use the remaining capacity. Integration within the shared memory/L1 cache 570 enables the shared memory/L1 cache 570 to function as a high-throughput conduit for streaming data while simultaneously providing high-bandwidth and low-latency access to frequently reused data.

When configured for general purpose parallel computation, a simpler configuration can be used compared with graphics processing. Specifically, the fixed function graphics processing units shown in FIG. 3, are bypassed, creating a much simpler programming model. In the general purpose parallel computation configuration, the work distribution unit 325 assigns and distributes blocks of threads directly to the DPCs 420. The threads in a block execute the same program, using a unique thread ID in the calculation to ensure each thread generates unique results, using the SM 440 to execute the program and perform calculations, shared memory/L1 cache 570 to communicate between threads, and the LSU 554 to read and write global memory through the shared memory/L1 cache 570 and the memory partition unit 380. When configured for general purpose parallel computation, the SM 440 can also write commands that the scheduler unit 320 can use to launch new work on the DPCs 420.

The PPU 300 may be included in a desktop computer, a laptop computer, a tablet computer, servers, supercomputers, a smart-phone (e.g., a wireless, hand-held device), personal digital assistant (PDA), a digital camera, a vehicle, a head mounted display, a hand-held electronic device, and the like. In an embodiment, the PPU 300 is embodied on a single semiconductor substrate. In another embodiment, the PPU 300 is included in a system-on-a-chip (SoC) along with one or more other devices such as additional PPUs 300, the memory 304, a reduced instruction set computer (RISC) CPU, a memory management unit (MMU), a digital-to-analog converter (DAC), and the like.

In an embodiment, the PPU 300 may be included on a graphics card that includes one or more memory devices. The graphics card may be configured to interface with a PCIe slot on a motherboard of a desktop computer. In yet another embodiment, the PPU 300 may be an integrated graphics processing unit (iGPU) or parallel processor included in the chipset of the motherboard.

Exemplary Computing System

Systems with multiple GPUs and CPUs are used in a variety of industries as developers expose and leverage more parallelism in applications such as artificial intelligence computing. High-performance GPU-accelerated systems with tens to many thousands of compute nodes are deployed in data centers, research facilities, and supercomputers to solve ever larger problems. As the number of processing devices within the high-performance systems increases, the communication and data transfer mechanisms need to scale to support the increased bandwidth.

Figure 5B:
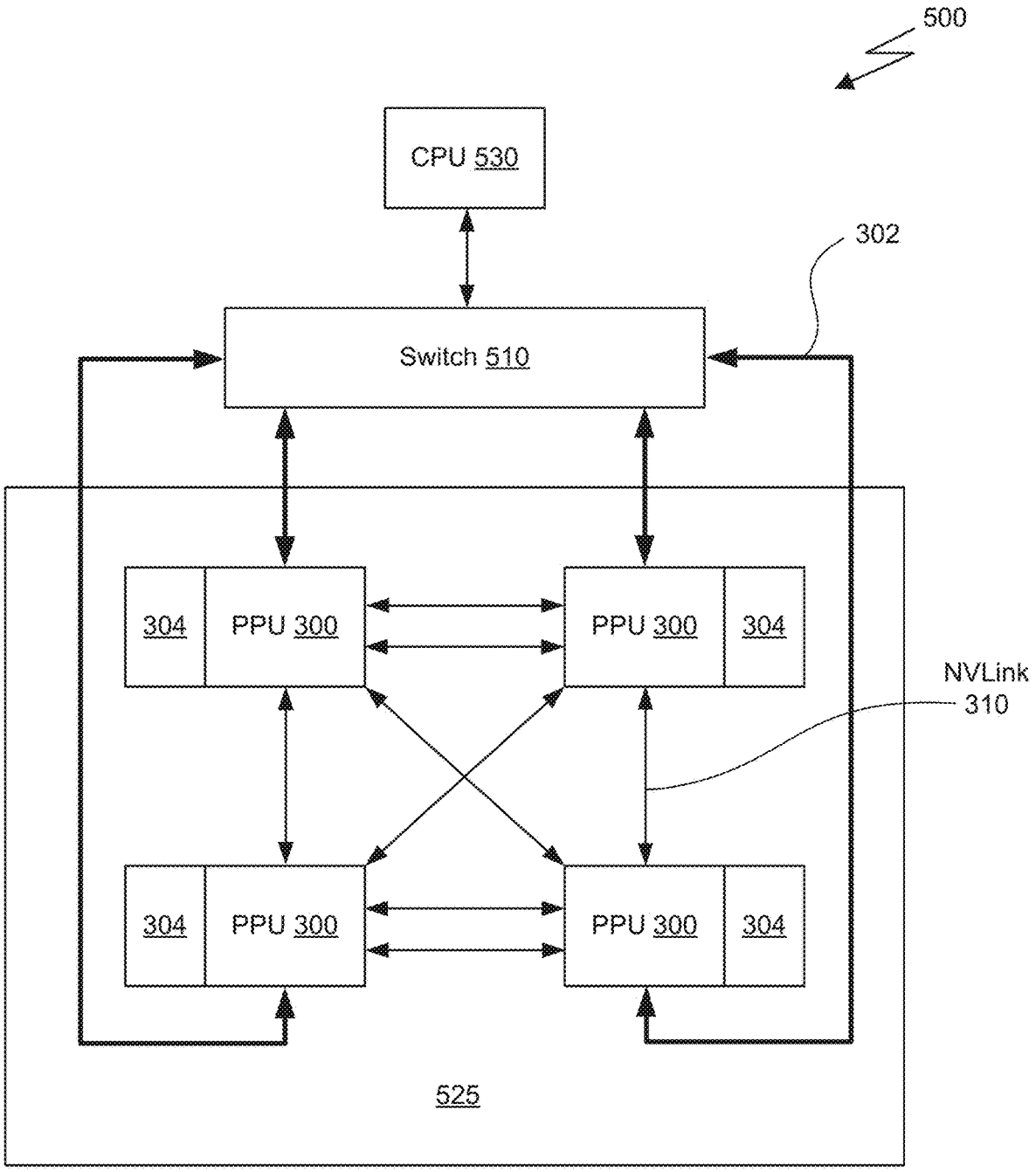
FIG. 5B is a conceptual diagram of a processing system implemented using the PPU of FIG. 3, in accordance with an embodiment.

FIG. 5B is a conceptual diagram of a processing system 500 implemented using the PPU 300 of FIG. 3, in accordance with an embodiment. The exemplary system 565 may be configured to implement the method 200 shown in FIG. 2. The processing system 500 includes a CPU 530, switch 510, and multiple PPUs 300, and respective memories 304. The NVLink 310 provides high-speed communication links between each of the PPUs 300. Although a particular number of NVLink 310 and interconnect 302 connections are illustrated in FIG. 5B, the number of connections to each PPU 300 and the CPU 530 may vary. The switch 510 interfaces between the interconnect 302 and the CPU 530. The PPUs 300, memories 304, and NVLinks 310 may be situated on a single semiconductor platform to form a parallel processing module 525. In an embodiment, the switch 510 supports two or more protocols to interface between various different connections and/or links.

In another embodiment (not shown), the NVLink 310 provides one or more high-speed communication links between each of the PPUs 300 and the CPU 530 and the switch 510 interfaces between the interconnect 302 and each of the PPUs 300. The PPUs 300, memories 304, and interconnect 302 may be situated on a single semiconductor platform to form a parallel processing module 525. In yet another embodiment (not shown), the interconnect 302 provides one or more communication links between each of the PPUs 300 and the CPU 530 and the switch 510 interfaces between each of the PPUs 300 using the NVLink 310 to provide one or more high-speed communication links between the PPUs 300. In another embodiment (not shown), the NVLink 310 provides one or more high-speed communication links between the PPUs 300 and the CPU 530 through the switch 510. In yet another embodiment (not shown), the interconnect 302 provides one or more communication links between each of the PPUs 300 directly. One or more of the NVLink 310 high-speed communication links may be implemented as a physical NVLink interconnect or either an on-chip or on-die interconnect using the same protocol as the NVLink 310.

In the context of the present description, a single semiconductor platform may refer to a sole unitary semiconductor-based integrated circuit fabricated on a die or chip. It should be noted that the term single semiconductor platform may also refer to multi-chip modules with increased connectivity which simulate on-chip operation and make substantial improvements over utilizing a conventional bus implementation. Of course, the various circuits or devices may also be situated separately or in various combinations of semiconductor platforms per the desires of the user. Alternately, the parallel processing module 525 may be implemented as a circuit board substrate and each of the PPUs 300 and/or memories 304 may be packaged devices. In an embodiment, the CPU 530, switch 510, and the parallel processing module 525 are situated on a single semiconductor platform.

In an embodiment, the signaling rate of each NVLink 310 is 20 to 25 Gigabits/second and each PPU 300 includes six NVLink 310 interfaces (as shown in FIG. 5B, five NVLink 310 interfaces are included for each PPU 300). Each NVLink 310 provides a data transfer rate of 25 Gigabytes/second in each direction, with six links providing 300 Gigabytes/second. The NVLinks 310 can be used exclusively for PPU-to-PPU communication as shown in FIG. 5B, or some combination of PPU-to-PPU and PPU-to-CPU, when the CPU 530 also includes one or more NVLink 310 interfaces.

In an embodiment, the NVLink 310 allows direct load/store/atomic access from the CPU 530 to each PPU's 300 memory 304. In an embodiment, the NVLink 310 supports coherency operations, allowing data read from the memories 304 to be stored in the cache hierarchy of the CPU 530, reducing cache access latency for the CPU 530. In an embodiment, the NVLink 310 includes support for Address Translation Services (ATS), allowing the PPU 300 to directly access page tables within the CPU 530. One or more of the NVLinks 310 may also be configured to operate in a low-power mode.

Figure 5C:
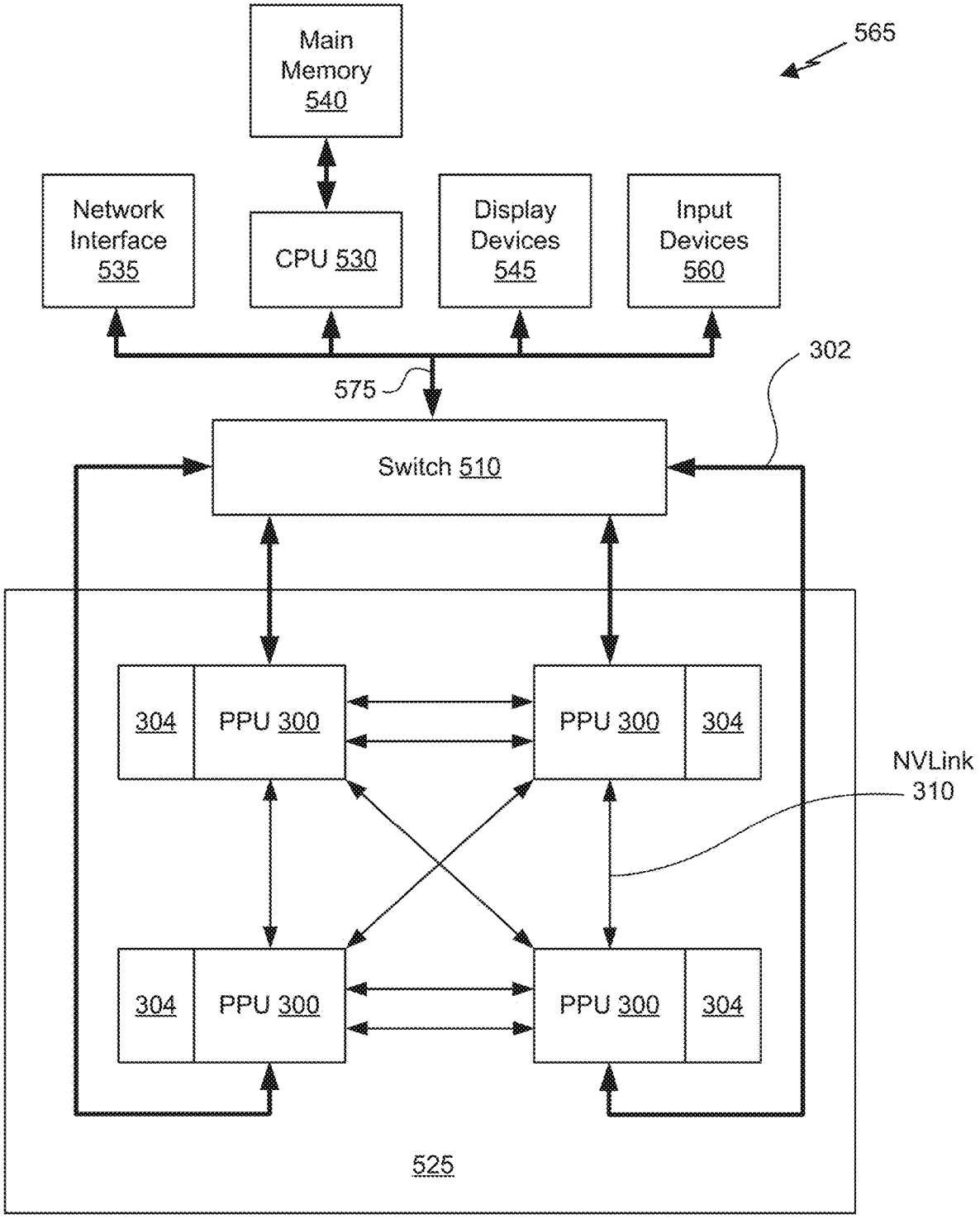
FIG. 5C illustrates an exemplary system in which the various architecture and/or functionality of the various previous embodiments may be implemented.

FIG. 5C illustrates an exemplary system 565 in which the various architecture and/or functionality of the various previous embodiments may be implemented. The exemplary system 565 may be configured to implement the method 200 shown in FIG. 2.

As shown, a system 565 is provided including at least one central processing unit 530 that is connected to a communication bus 575. The communication bus 575 may be implemented using any suitable protocol, such as PCI (Peripheral Component Interconnect), PCI-Express, AGP (Accelerated Graphics Port), HyperTransport, or any other bus or point-to-point communication protocol(s). The system 565 also includes a main memory 540. Control logic (software) and data are stored in the main memory 540 which may take the form of random access memory (RAM).

The system 565 also includes input devices 560, the parallel processing system 525, and display devices 545, e.g. a conventional CRT (cathode ray tube), LCD (liquid crystal display), LED (light emitting diode), plasma display or the like. User input may be received from the input devices 560, e.g., keyboard, mouse, touchpad, microphone, and the like. Each of the foregoing modules and/or devices may even be situated on a single semiconductor platform to form the system 565. Alternately, the various modules may also be situated separately or in various combinations of semiconductor platforms per the desires of the user.

Further, the system 565 may be coupled to a network (e.g., a telecommunications network, local area network (LAN), wireless network, wide area network (WAN) such as the Internet, peer-to-peer network, cable network, or the like) through a network interface 535 for communication purposes.

The system 565 may also include a secondary storage (not shown). The secondary storage 610 includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner.

Computer programs, or computer control logic algorithms, may be stored in the main memory 540 and/or the secondary storage. Such computer programs, when executed, enable the system 565 to perform various functions. The memory 540, the storage, and/or any other storage are possible examples of computer-readable media.

The architecture and/or functionality of the various previous figures may be implemented in the context of a general computer system, a circuit board system, a game console system dedicated for entertainment purposes, an application-specific system, and/or any other desired system. For example, the system 565 may take the form of a desktop computer, a laptop computer, a tablet computer, servers, supercomputers, a smart-phone (e.g., a wireless, hand-held device), personal digital assistant (PDA), a digital camera, a vehicle, a head mounted display, a hand-held electronic device, a mobile phone device, a television, workstation, game consoles, embedded system, and/or any other type of logic.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

Graphics Processing Pipeline

In an embodiment, the PPU 300 comprises a graphics processing unit (GPU). The PPU 300 is configured to receive commands that specify shader programs for processing graphics data. Graphics data may be defined as a set of primitives such as points, lines, triangles, quads, triangle strips, and the like. Typically, a primitive includes data that specifies a number of vertices for the primitive (e.g., in a model-space coordinate system) as well as attributes associated with each vertex of the primitive. The PPU 300 can be configured to process the graphics primitives to generate a frame buffer (e.g., pixel data for each of the pixels of the display).

An application writes model data for a scene (e.g., a collection of vertices and attributes) to a memory such as a system memory or memory 304. The model data defines each of the objects that may be visible on a display. The application then makes an API call to the driver kernel that requests the model data to be rendered and displayed. The driver kernel reads the model data and writes commands to the one or more streams to perform operations to process the model data. The commands may reference different shader programs to be implemented on the SMs 440 of the PPU 300 including one or more of a vertex shader, hull shader, domain shader, geometry shader, and a pixel shader. For example, one or more of the SMs 440 may be configured to execute a vertex shader program that processes a number of vertices defined by the model data. In an embodiment, the different SMs 440 may be configured to execute different shader programs concurrently. For example, a first subset of SMs 440 may be configured to execute a vertex shader program while a second subset of SMs 440 may be configured to execute a pixel shader program. The first subset of SMs 440 processes vertex data to produce processed vertex data and writes the processed vertex data to the L2 cache 460 and/or the memory 304. After the processed vertex data is rasterized (e.g., transformed from three-dimensional data into two-dimensional data in screen space) to produce fragment data, the second subset of SMs 440 executes a pixel shader to produce processed fragment data, which is then blended with other processed fragment data and written to the frame buffer in memory 304. The vertex shader program and pixel shader program may execute concurrently, processing different data from the same scene in a pipelined fashion until all of the model data for the scene has been rendered to the frame buffer. Then, the contents of the frame buffer are transmitted to a display controller for display on a display device.

Figure 6:
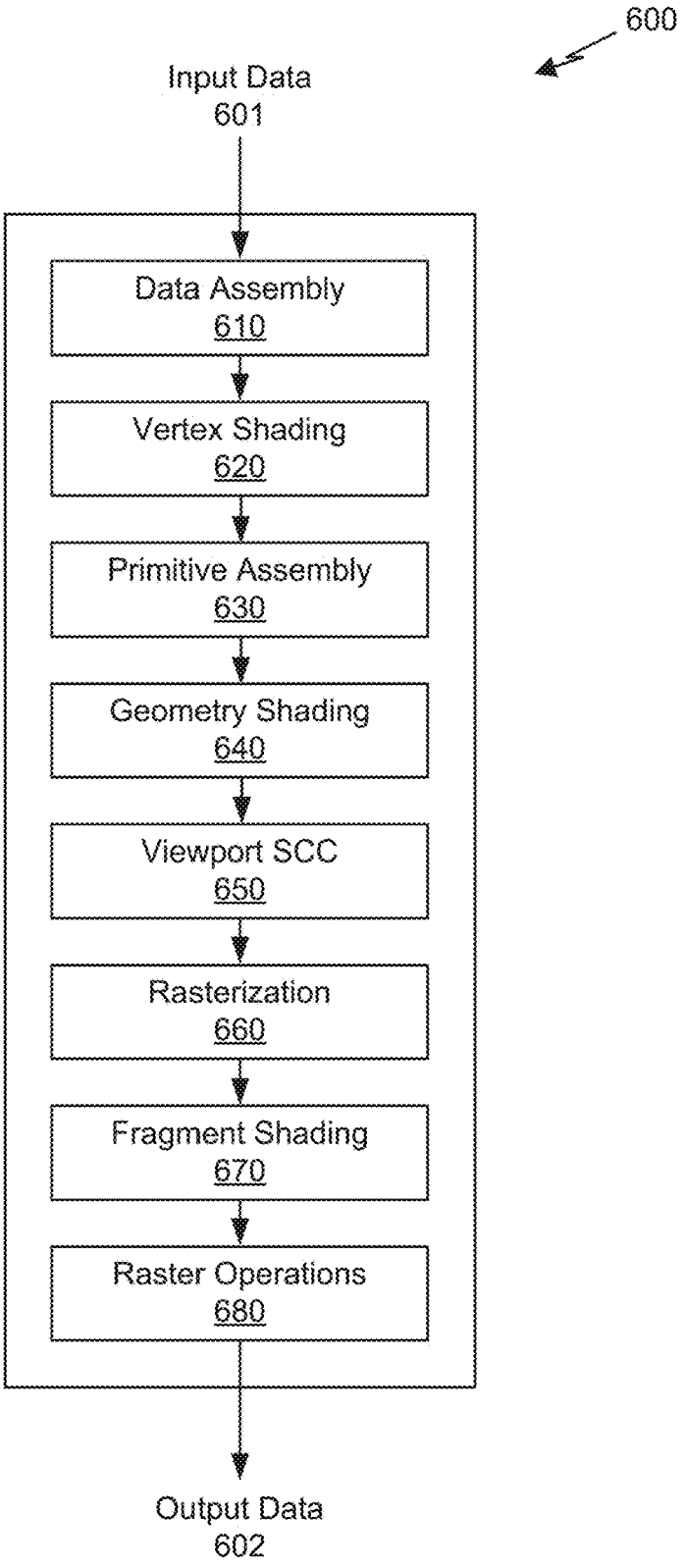
FIG. 6 is a conceptual diagram of a graphics processing pipeline implemented by the PPU of FIG. 3, in accordance with an embodiment.

FIG. 6 is a conceptual diagram of a graphics processing pipeline 600 implemented by the PPU 300 of FIG. 3, in accordance with an embodiment. The graphics processing pipeline 600 is an abstract flow diagram of the processing steps implemented to generate 2D computer-generated images from 3D geometry data. As is well-known, pipeline architectures may perform long latency operations more efficiently by splitting up the operation into a plurality of stages, where the output of each stage is coupled to the input of the next successive stage. Thus, the graphics processing pipeline 600 receives input data 601 that is transmitted from one stage to the next stage of the graphics processing pipeline 600 to generate output data 602. In an embodiment, the graphics processing pipeline 600 may represent a graphics processing pipeline defined by the OpenGL® API. As an option, the graphics processing pipeline 600 may be implemented in the context of the functionality and architecture of the previous Figures and/or any subsequent Figure(s).

As shown in FIG. 6, the graphics processing pipeline 600 comprises a pipeline architecture that includes a number of stages. The stages include, but are not limited to, a data assembly stage 610, a vertex shading stage 620, a primitive assembly stage 630, a geometry shading stage 640, a viewport scale, cull, and clip (VSCC) stage 650, a rasterization stage 660, a fragment shading stage 670, and a raster operations stage 680. In an embodiment, the input data 601 comprises commands that configure the processing units to implement the stages of the graphics processing pipeline 600 and geometric primitives (e.g., points, lines, triangles, quads, triangle strips or fans, etc.) to be processed by the stages. The output data 602 may comprise pixel data (e.g., color data) that is copied into a frame buffer or other type of surface data structure in a memory.

The data assembly stage 610 receives the input data 601 that specifies vertex data for high-order surfaces, primitives, or the like. The data assembly stage 610 collects the vertex data in a temporary storage or queue, such as by receiving a command from the host processor that includes a pointer to a buffer in memory and reading the vertex data from the buffer. The vertex data is then transmitted to the vertex shading stage 620 for processing.

The vertex shading stage 620 processes vertex data by performing a set of operations (e.g., a vertex shader or a program) once for each of the vertices. Vertices may be, e.g., specified as a 4-coordinate vector (e.g., <x, y, z, w>) associated with one or more vertex attributes (e.g., color, texture coordinates, surface normal, etc.). The vertex shading stage 620 may manipulate individual vertex attributes such as position, color, texture coordinates, and the like. In other words, the vertex shading stage 620 performs operations on the vertex coordinates or other vertex attributes associated with a vertex. Such operations commonly including lighting operations (e.g., modifying color attributes for a vertex) and transformation operations (e.g., modifying the coordinate space for a vertex). For example, vertices may be specified using coordinates in an object-coordinate space, which are transformed by multiplying the coordinates by a matrix that translates the coordinates from the object-coordinate space into a world space or a normalized-device-coordinate (NCD) space. The vertex shading stage 620 generates transformed vertex data that is transmitted to the primitive assembly stage 630.

The primitive assembly stage 630 collects vertices output by the vertex shading stage 620 and groups the vertices into geometric primitives for processing by the geometry shading stage 640. For example, the primitive assembly stage 630 may be configured to group every three consecutive vertices as a geometric primitive (e.g., a triangle) for transmission to the geometry shading stage 640. In some embodiments, specific vertices may be reused for consecutive geometric primitives (e.g., two consecutive triangles in a triangle strip may share two vertices). The primitive assembly stage 630 transmits geometric primitives (e.g., a collection of associated vertices) to the geometry shading stage 640.

The geometry shading stage 640 processes geometric primitives by performing a set of operations (e.g., a geometry shader or program) on the geometric primitives. Tessellation operations may generate one or more geometric primitives from each geometric primitive. In other words, the geometry shading stage 640 may subdivide each geometric primitive into a finer mesh of two or more geometric primitives for processing by the rest of the graphics processing pipeline 600. The geometry shading stage 640 transmits geometric primitives to the viewport SCC stage 650.

In an embodiment, the graphics processing pipeline 600 may operate within a streaming multiprocessor and the vertex shading stage 620, the primitive assembly stage 630, the geometry shading stage 640, the fragment shading stage 670, and/or hardware/software associated therewith, may sequentially perform processing operations. Once the sequential processing operations are complete, in an embodiment, the viewport SCC stage 650 may utilize the data. In an embodiment, primitive data processed by one or more of the stages in the graphics processing pipeline 600 may be written to a cache (e.g. L1 cache, a vertex cache, etc.). In this case, in an embodiment, the viewport SCC stage 650 may access the data in the cache. In an embodiment, the viewport SCC stage 650 and the rasterization stage 660 are implemented as fixed function circuitry.

The viewport SCC stage 650 performs viewport scaling, culling, and clipping of the geometric primitives. Each surface being rendered to is associated with an abstract camera position. The camera position represents a location of a viewer looking at the scene and defines a viewing frustum that encloses the objects of the scene. The viewing frustum may include a viewing plane, a rear plane, and four clipping planes. Any geometric primitive entirely outside of the viewing frustum may be culled (e.g., discarded) because the geometric primitive will not contribute to the final rendered scene. Any geometric primitive that is partially inside the viewing frustum and partially outside the viewing frustum may be clipped (e.g., transformed into a new geometric primitive that is enclosed within the viewing frustum. Furthermore, geometric primitives may each be scaled based on a depth of the viewing frustum. All potentially visible geometric primitives are then transmitted to the rasterization stage 660.

The rasterization stage 660 converts the 3D geometric primitives into 2D fragments (e.g. capable of being utilized for display, etc.). The rasterization stage 660 may be configured to utilize the vertices of the geometric primitives to setup a set of plane equations from which various attributes can be interpolated. The rasterization stage 660 may also compute a coverage mask for a plurality of pixels that indicates whether one or more sample locations for the pixel intercept the geometric primitive. In an embodiment, z-testing may also be performed to determine if the geometric primitive is occluded by other geometric primitives that have already been rasterized. The rasterization stage 660 generates fragment data (e.g., interpolated vertex attributes associated with a particular sample location for each covered pixel) that are transmitted to the fragment shading stage 670.

The fragment shading stage 670 processes fragment data by performing a set of operations (e.g., a fragment shader or a program) on each of the fragments. The fragment shading stage 670 may generate pixel data (e.g., color values) for the fragment such as by performing lighting operations or sampling texture maps using interpolated texture coordinates for the fragment. The fragment shading stage 670 generates pixel data that is transmitted to the raster operations stage 680.

The raster operations stage 680 may perform various operations on the pixel data such as performing alpha tests, stencil tests, and blending the pixel data with other pixel data corresponding to other fragments associated with the pixel. When the raster operations stage 680 has finished processing the pixel data (e.g., the output data 602), the pixel data may be written to a render target such as a frame buffer, a color buffer, or the like.

It will be appreciated that one or more additional stages may be included in the graphics processing pipeline 600 in addition to or in lieu of one or more of the stages described above. Various implementations of the abstract graphics processing pipeline may implement different stages. Furthermore, one or more of the stages described above may be excluded from the graphics processing pipeline in some embodiments (such as the geometry shading stage 640). Other types of graphics processing pipelines are contemplated as being within the scope of the present disclosure. Furthermore, any of the stages of the graphics processing pipeline 600 may be implemented by one or more dedicated hardware units within a graphics processor such as PPU 300. Other stages of the graphics processing pipeline 600 may be implemented by programmable hardware units such as the SM 440 of the PPU 300.

The graphics processing pipeline 600 may be implemented via an application executed by a host processor, such as a CPU. In an embodiment, a device driver may implement an application programming interface (API) that defines various functions that can be utilized by an application in order to generate graphical data for display. The device driver is a software program that includes a plurality of instructions that control the operation of the PPU 300. The API provides an abstraction for a programmer that lets a programmer utilize specialized graphics hardware, such as the PPU 300, to generate the graphical data without requiring the programmer to utilize the specific instruction set for the PPU 300. The application may include an API call that is routed to the device driver for the PPU 300. The device driver interprets the API call and performs various operations to respond to the API call. In some instances, the device driver may perform operations by executing instructions on the CPU. In other instances, the device driver may perform operations, at least in part, by launching operations on the PPU 300 utilizing an input/output interface between the CPU and the PPU 300. In an embodiment, the device driver is configured to implement the graphics processing pipeline 600 utilizing the hardware of the PPU 300.

Various programs may be executed within the PPU 300 in order to implement the various stages of the graphics processing pipeline 600. For example, the device driver may launch a kernel on the PPU 300 to perform the vertex shading stage 620 on one SM 440 (or multiple SMs 440). The device driver (or the initial kernel executed by the PPU 400) may also launch other kernels on the PPU 400 to perform other stages of the graphics processing pipeline 600, such as the geometry shading stage 640 and the fragment shading stage 670. In addition, some of the stages of the graphics processing pipeline 600 may be implemented on fixed unit hardware such as a rasterizer or a data assembler implemented within the PPU 400. It will be appreciated that results from one kernel may be processed by one or more intervening fixed function hardware units before being processed by a subsequent kernel on an SM 440.

Machine Learning

Deep neural networks (DNNs) developed on processors, such as the PPU 300 have been used for diverse use cases, from self-driving cars to faster drug development, from automatic image captioning in online image databases to smart real-time language translation in video chat applications. Deep learning is a technique that models the neural learning process of the human brain, continually learning, continually getting smarter, and delivering more accurate results more quickly over time. A child is initially taught by an adult to correctly identify and classify various shapes, eventually being able to identify shapes without any coaching. Similarly, a deep learning or neural learning system needs to be trained in object recognition and classification for it get smarter and more efficient at identifying basic objects, occluded objects, etc., while also assigning context to objects.

At the simplest level, neurons in the human brain look at various inputs that are received, importance levels are assigned to each of these inputs, and output is passed on to other neurons to act upon. An artificial neuron or perceptron is the most basic model of a neural network. In one example, a perceptron may receive one or more inputs that represent various features of an object that the perceptron is being trained to recognize and classify, and each of these features is assigned a certain weight based on the importance of that feature in defining the shape of an object.

A deep neural network (DNN) model includes multiple layers of many connected nodes (e.g., perceptrons, Boltzmann machines, radial basis functions, convolutional layers, etc.) that can be trained with enormous amounts of input data to quickly solve complex problems with high accuracy.

In one example, a first layer of the DNN model breaks down an input image of an automobile into various sections and looks for basic patterns such as lines and angles. The second layer assembles the lines to look for higher level patterns such as wheels, windshields, and mirrors. The next layer identifies the type of vehicle, and the final few layers generate a label for the input image, identifying the model of a specific automobile brand.

Once the DNN is trained, the DNN can be deployed and used to identify and classify objects or patterns in a process known as inference. Examples of inference (the process through which a DNN extracts useful information from a given input) include identifying handwritten numbers on checks deposited into ATM machines, identifying images of friends in photos, delivering movie recommendations to over fifty million users, identifying and classifying different types of automobiles, pedestrians, and road hazards in driverless cars, or translating human speech in real-time.

During training, data flows through the DNN in a forward propagation phase until a prediction is produced that indicates a label corresponding to the input. If the neural network does not correctly label the input, then errors between the correct label and the predicted label are analyzed, and the weights are adjusted for each feature during a backward propagation phase until the DNN correctly labels the input and other inputs in a training dataset. Training complex neural networks requires massive amounts of parallel computing performance, including floating-point multiplications and additions that are supported by the PPU 300. Inferencing is less compute-intensive than training, being a latency-sensitive process where a trained neural network is applied to new inputs it has not seen before to classify images, translate speech, and generally infer new information.

Neural networks rely heavily on matrix math operations, and complex multi-layered networks require tremendous amounts of floating-point performance and bandwidth for both efficiency and speed. With thousands of processing cores, optimized for matrix math operations, and delivering tens to hundreds of TFLOPS of performance, the PPU 300 is a computing platform capable of delivering performance required for deep neural network-based artificial intelligence and machine learning applications.

Patch Scanning Technique

Various features or concepts related to a patch scanning technique are described in more detail below. In some embodiments, the patch scanning technique can be applied to the output of a conventional graphics processing pipeline such as graphics processing pipeline 600. For example, the output data 602 represents a target image frame and the controller 110 can include a matrix or tensor processing unit that is utilized to analyze the output data 602 to generate corresponding basis functions used in generating the backlight signal 102 and/or modulation signal 104. In other words, the graphics processing pipeline 600 can be augmented by adding a patch scanning engine to the end of the pipeline to generate the corresponding signals. In other embodiments, the target image frames can be captured via a photosensor or read from a image file or video stream and processed via the controller 110.

Figure 7:
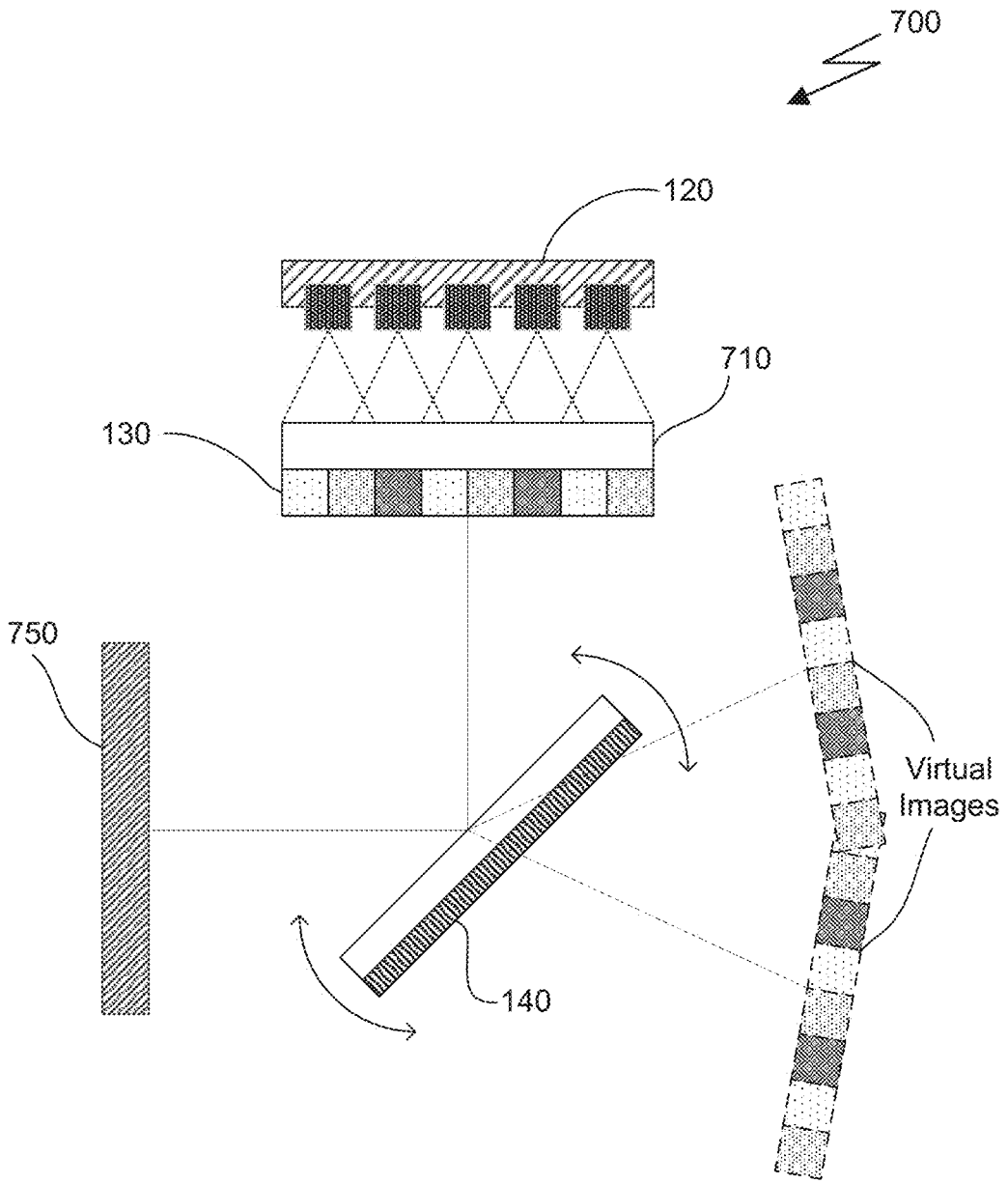
FIG. 7 illustrates a patch scanning display, in accordance with some embodiments.

FIG. 7 illustrates a patch scanning display 700, in accordance with some embodiments. The PSD 700 includes a backlight 120, a SLM 130, and an optical scanning device 140. The backlight 120 comprises a two-dimensional array of light-emitting elements, which illuminates the SLM 130 according to the backlight signal 102. The SLM 130 comprises a two-dimensional array of light-modulating elements. In an embodiment, each "pixel" of the SLM 130 comprises a plurality of light-modulating elements corresponding to two or more color channels. Light shone from the backlight 120 propagate through the SLM 130, where the light is modulated according to the SLM signal 104. Then the image projected from the SLM 130 is transformed by the optical scanning device 140 and reflects to the projection surface 750, where the target image frame is reconstructed.

The optical scanning device 140, in some embodiments, performs scanning through adjusting the path of the image. The optical components of the optical scanning device 140 can cause the image to be translated on the projection surface. In some embodiments, the optical components of the optical scanning device 140 can cause rotation of the projected image around a projection axis in addition to translation.

In some embodiments, a diffuser film 710 can be placed between the backlight 120 and the SLM 130. Each light-emitting element of the backlight 120 can include light sources for a plurality of different colors. For example, a light-emitting element can include a red LED, a blue LED, and a green LED. Such LEDs can be activated separately to generate any of the three primary colors, activated in corresponding pairs to generate mixed secondary colors, or all activated to generate "white" light. The light of a specific wavelength or short bandwidth of wavelengths interacts with color filters associated with each light-modulating element of the SLM 130 such that light of a particular color is only transmitted through a subset of the light-modulating elements associated with a particular color filter. The diffuser film 710 spreads the light from multiple light sources within a light-emitting element over an area of the SLM 130 corresponding with one or more light-modulating elements.

In some embodiments, the projection surface is a flat white surface. In other embodiments, the projection surface is a translucent or transparent surface such as a glass or plastic surface implemented in AR glasses or a heads-up display (HUD). In yet other embodiments, the projection surface is a retina of a user's eye. It will be appreciated that the projection surface can be any surface on which the image can be projected and reflected towards the eye of a viewer, including curved surfaces.

In an embodiment, the optical scanning device 140 includes a DMD. Digital signals can be used to tilt the mirror around one or multiple axes in order to redirect the image projected onto the surface of the mirror included in the DMD. Although FIG. 7 only shows a single multi-axis DMD used for translating the image in both x and y dimensions on the projection surface, in other embodiments, multiple single axis DMD devices may be included in the optical scanning device 140, such that each DMD device translates the image in a single axis. It will be appreciated that there are many possible techniques for transforming the location and/or orientation of the image projected by the SLM 130 on the projection surface including various MEMS devices as well as optical components such as prisms and mirrors. The optical scanning device 140 is contemplated as being any device that can be controlled to scan an image on the projection surface.

Figures 8A, 8B, 8C:
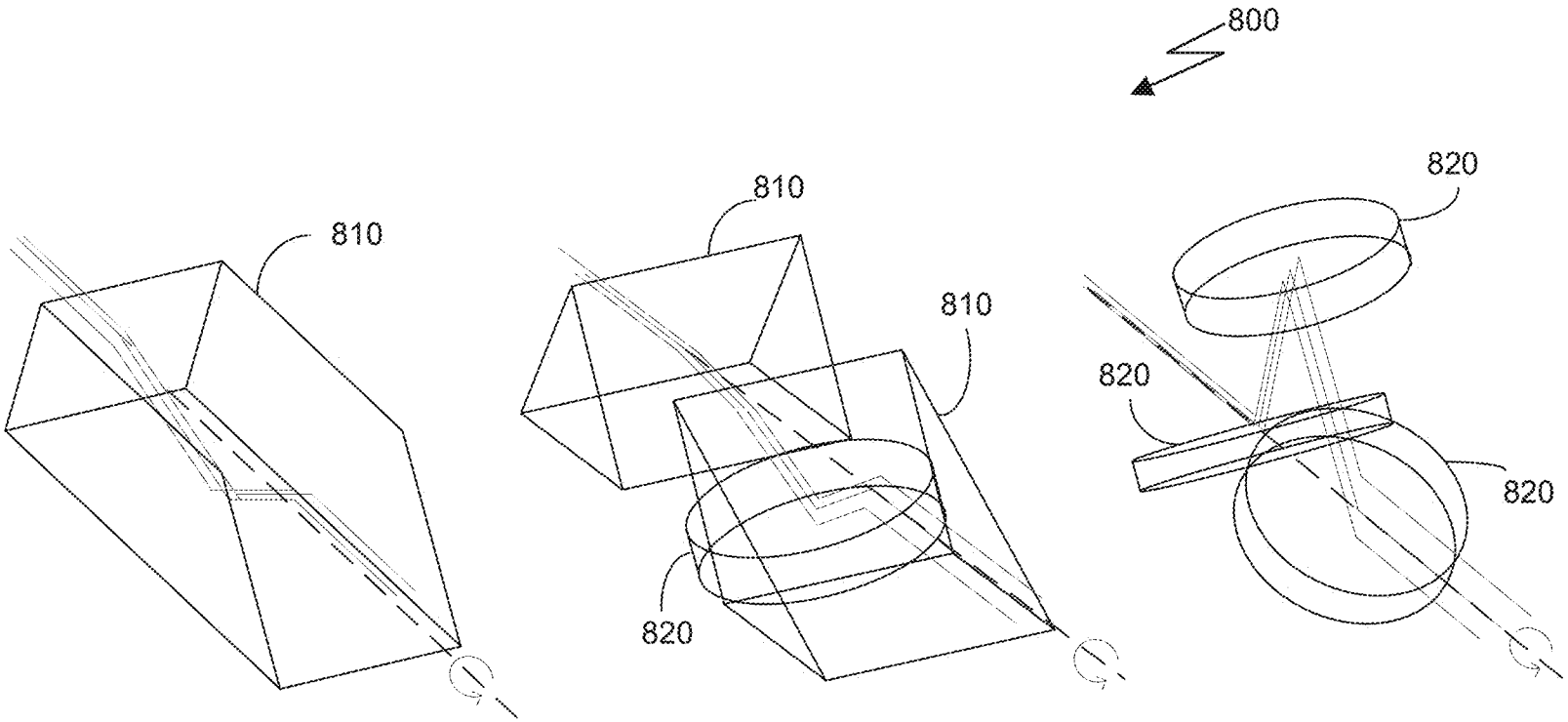
FIGS. 8A-8C illustrate traditional optical image rotators, in accordance with some embodiments.

FIGS. 8A-8C illustrate traditional optical image rotators 800, in accordance with some embodiments. Conventional optical image rotators 800 include prisms 810 and/or mirrors 820, which can be utilized to conduct optical scanning that incorporates a rotational transformation. An optical image rotator 800 rotates an entire image of an object about an optical axis. One or more of the prisms and/or mirrors 820 can be rotated relative to the optical axis and/or the various other optical components of the optical image rotators 800 in order to cause the image to rotate about the optical axis. In some embodiments, the optical image rotators 800, or components thereof, can be included in the optical scanning device 140 in order to implement a scan trajectory associated with a rotation transformation.

Figure 9:
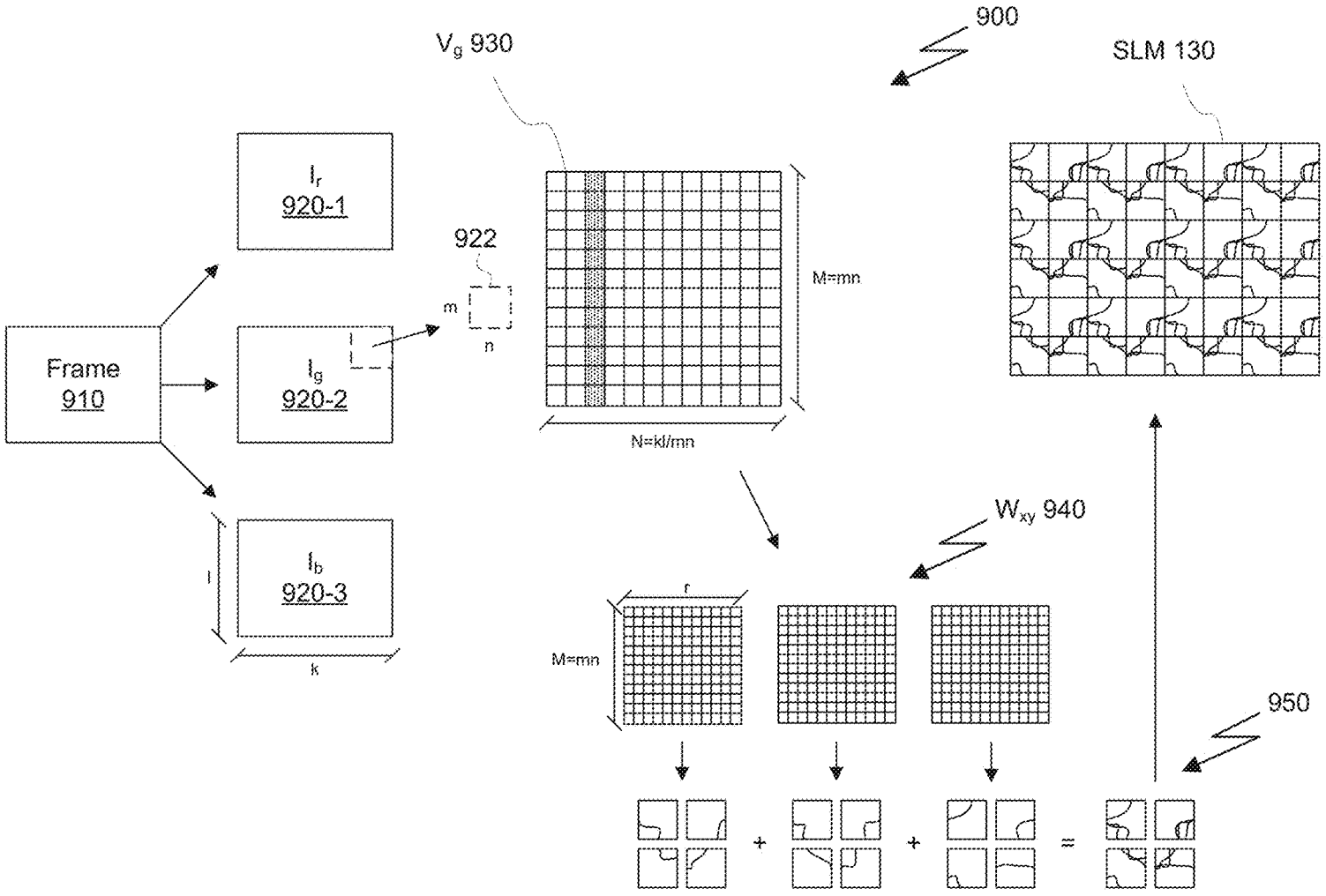
FIG. 9 illustrates the projective non-negative matrix factorization decomposition model, in accordance with some embodiments.

FIG. 9 illustrates the P-NMF decomposition model 900, in accordance with some embodiments. As depicted in FIG. 9, a target image frame 910 is received and split into a number of separate single channel images 920, with one image 920 for each color channel of the target image frame 910. For example, the target image frame 910 can include three color channels, which are split into a first image channel $I_r$ 920-1, a second image channel $I_g$ 920-2, and a third image channel $I_b$ 920-3.

Each image 920 can be divided into a number of image tiles 922 of dimension m×n. The input data matrix V 930 of dimension M×N is then generated by vectorising the image tiles 922 to create the different columns of the matrix V 930. Although a single matrix $V_g$ 930 is shown in FIG. 9, a separate matrix is created for each color channel, such as $V_r$, $V_g$, and $V_b$. It will also be appreciated that this process is repeated for each time step of the scan trajectory by applying a transformation to the target image frame 910, splitting the target image frame into per-color channel images 920, and generating the corresponding matrices V 930 for each color channel during that time step.

A matrix $W_{xy}$ 940, for each color channel, having dimension M× r is initialized using random values. The matrices $W_{xy}$ 940 are then updated according to a multiplicative update rule based on the input data matrices for each time step in a number of different time steps of the scan trajectory. The matrices $W_{xy}$ 940, after optimization, contain columns that represent basis functions. The basis functions can be transformed into image patches for a particular color channel. The rank of the matrix $W_{xy}$ 940 determines the number of image patches, and these image patches are then superimposed with the image patches for other color channels to generate a set of image patches 950 that are tiled across the SLM 130 in accordance with the modulation signal in order to modulate the light projected through the SLM 130 by the backlight 120 during the frame period.

It will be appreciated that the decomposition of an image into a set of basis functions can be used as an encryption technique. More specifically, the image produced by the SLM 130 in accordance with the modulation signal does not contain enough information to reproduce the target image frame. Even with a priori knowledge of the scan trajectory, the target image frame cannot be reproduced accurately without the corresponding backlight signal. Therefore, in some embodiments, the controller 110 can encrypt the backlight signal using, e.g., key encryption techniques to ensure that only a client (e.g., the controller of the PSD or a controller external to the PSD) having the associated key is able to reconstruct the target image frame from the modulation signal and decrypted backlight signal. In some embodiments, the modulation signal and the backlight signal can be encrypted using different keys as an additional layer of security and transmitted using different channels. In some embodiments, the scan trajectory signal can be encoded with at least one of the modulation signal or the backlight signal. The scan trajectory signal can be encrypted or not encrypted. For example, in some embodiments, a scan trajectory can be indicated in a header of a data frame encapsulating the backlight signal. The payload of the data frame can include the encrypted backlight signal while the header is not encypted. The scan trajectory can be indicated with a code (e.g., 8-bit value) that indicates one of a plurality of pre-coded scan trajectories. In other embodiments, the scan trajectory signal can be encoded and encrypted along with one or both of the backlight signal and the modulation signal.

Furthermore, it will be appreciated that the scan trajectory can be changed, which will require alteration of the set of image patches and the backlight signal in order to reconstruct the target image frame. By arranging for PSDs to periodically change the scan trajectory, or utilize a random scan trajectory that is communicated to a remote service prior to generation of the modulation signal and backlight signal, the delivered content can be tailored to that particular PSD. The same modulation signal and backlight signal would not be viewable on other devices utilizing different scan trajectories.

These security techniques can be used to scramble the signal to only grant certain clients access to view the signal. For example, a streaming service could be configured to change the encoding of content periodically. Clients having appropriate credentials could be required to request the scan trajectory associated with a signal using the credentials in order to properly decode the signal. A content service implemented by one or more servers can be configured to receive a request for the encryption key from a client. The request includes credentials from the client utilized to determine whether the client is permitted access to reconstruct the target image frame. If access is permitted, the content service sends a response to the client including the required decryption information (e.g., a decryption key).

Subscription services could benefit because a user that canceled the service would not be able to determine which scan trajectory was being used for new content or decrypt the backlight signal without the proper credentials to access such information. While a brute force method of selecting a scan trajectory from a number of pre-set scan trajectories may be used to reconstruct an image with unencrypted modulation and backlight signals, having large numbers of possible scan trajectories could make such attempts impractical. In addition, varying the scan trajectory randomly rather than having a fixed number of pre-set scan trajectories would be able to combat this issue if the PSD is designed with optical scanning devices 140 with such capability.

It is noted that the techniques described herein may be embodied in executable instructions stored in a computer readable medium for use by or in connection with a processor-based instruction execution machine, system, apparatus, or device. It will be appreciated by those skilled in the art that, for some embodiments, various types of computer-readable media can be included for storing data. As used herein, a "computer-readable medium" includes one or more of any suitable media for storing the executable instructions of a computer program such that the instruction execution machine, system, apparatus, or device may read (or fetch) the instructions from the computer-readable medium and execute the instructions for carrying out the described embodiments. Suitable storage formats include one or more of an electronic, magnetic, optical, and electromagnetic format. A non-exhaustive list of conventional exemplary computer-readable medium includes: a portable computer diskette; a random-access memory (RAM); a read-only memory (ROM); an erasable programmable read only memory (EPROM); a flash memory device; and optical storage devices, including a portable compact disc (CD), a portable digital video disc (DVD), and the like.

It should be understood that the arrangement of components illustrated in the attached Figures are for illustrative purposes and that other arrangements are possible. For example, one or more of the elements described herein may be realized, in whole or in part, as an electronic hardware component. Other elements may be implemented in software, hardware, or a combination of software and hardware. Moreover, some or all of these other elements may be combined, some may be omitted altogether, and additional components may be added while still achieving the functionality described herein. Thus, the subject matter described herein may be embodied in many different variations, and all such variations are contemplated to be within the scope of the claims.

To facilitate an understanding of the subject matter described herein, many aspects are described in terms of sequences of actions. It will be recognized by those skilled in the art that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar references in the context of describing the subject matter (particularly in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. Furthermore, the foregoing description is for the purpose of illustration only, and not for the purpose of limitation, as the scope of protection sought is defined by the claims as set forth hereinafter together with any equivalents thereof. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

What is claimed is:

1. A method for reconstructing a target image frame using a patch scanning technique, the method comprising:

receiving the target image frame;

generating a set of image patches corresponding to the target image frame in accordance with a decomposition model and a scan trajectory, wherein the decomposition model comprises a projective non-negative matrix factorization (P-NMF) model;

generating a modulation signal for a spatial light modulator (SLM) based on the set of image patches; and generating a backlight signal for a backlight for each time step in a plurality of time steps of the scan trajectory, wherein generating the set of image patches comprises:

for each color channel of the target image frame:

generating an input data matrix for each time step of the scan trajectory by vectorising a plurality of image tiles of a transformed version of the target image frame corresponding to the time step of the scan trajectory, determining a plurality of basis functions using the P-NMF model based on the input data matrices for a number of time steps, and transforming the plurality of basis functions into image patches for the color channel; and superimposing the image patches for each color channel to generate the set of image patches.

2. The method of claim 1, further comprising transmitting the modulation signal and the backlight signal to a patch scanning display (PSD) to project a reconstructed version of the target image frame on a projection surface, the PSD comprising:

the backlight, wherein the backlight includes a two-dimensional array of light-emitting elements that are activated or deactivated in accordance with the backlight signal;

the SLM, wherein the SLM includes a two-dimensional array of light-modulating elements that are configured to modulate an amplitude and/or a phase of light emitted from the light-emitting elements of the backlight in accordance with the modulation signal; and an optical scanning device configured to project an image formed by the SLM onto the projection surface in accordance with the scan trajectory.

3. The method of claim 2, wherein each light-emitting element includes a plurality of light sources, each light source emitting light of a particular color of a plurality of different colors, and wherein the light sources are one of light-emitting diodes (LEDs), microLEDs, organic LEDs (OLEDs), or lasers.

4. The method of claim 2, wherein each light-modulating element includes one or more of: a liquid crystal display (LCD) element or a digital micromirror device (DMD) element.

5. The method of claim 1, wherein determining the plurality of basis functions comprises:

updating a matrix W according to a multiplicative update rule given by the following:

$$W_{xy} \leftarrow W_{xy} \frac{(VV^T W)_{xy}}{(WW^T VV^T W)_{xy} - (VV^T WW^T W)_{xy}},$$

wherein V represents the input data matrix for a particular time step.

6. The method of claim 1, wherein generating the backlight signal comprises:

for each time step of the scan trajectory signal:

calculating, for each light-emitting element of the backlight, a difference between a target image frame and a reconstructed image at one or more locations corresponding to the light-emitting element, wherein the reconstructed image is determined in accordance with the following equation:

$$R(x, y) = \sum_{t=t_0}^{t_n} T((O_t \odot S_t),\ t)\left(1 - e^{\frac{t_n - t}{\tau}}\right),$$

wherein $O_t \odot S_t$ represents an element-wise multiplication of the backlight signal $O_t$ at time step t with modulation signal $S_t$, T represents a transformation based on the scan trajectory, $t_n$ represents a number of time steps in a frame period, and $\tau$ represents a time constant associated with a human visual system (HVS); and determining the backlight signal at that time step based on the difference.

7. The method of claim 1, wherein the set of image patches, the modulation signal, and the backlight signal are generated by a parallel processing unit.

8. The method of claim 1, wherein the scan trajectory is classified as one of scanline scanning, sinusoidal scanning, rotating scanning, or spiral scanning.

9. The method of claim 1, wherein the backlight signal is encoded based on an encryption key, the method further comprising receiving a request for the encryption key from a client, wherein the request includes credentials utilized to determine whether the client is permitted access to reconstruct the target image frame.

10. A patch scanning display apparatus, comprising:

a backlight that includes a two-dimensional (2D) array of light-emitting elements;

a spatial light modulator (SLM) that includes a 2D array of light-modulating elements, wherein each light-emitting element of the backlight corresponds to one or more of light-modulating elements of the SLM and light generated by the light-emitting elements in accordance with a backlight signal is modulated as the light is transmitted through the light-modulating elements in accordance with a modulation signal; and an optical scanning device configured to scan the image projected by the SLM on a projection surface in accordance with a scan trajectory, wherein the backlight signal and the modulation signal for a target image frame are generated by:

analyzing the target image frame to generate a set of image patches based on a decomposition model and the scan trajectory, wherein the decomposition model comprises a projective non-negative matrix factorization (P-NMF) model;

generating the modulation signal based on the set of image patches; and generating, for each time step of the scan trajectory, the backlight signal based on a difference between the target image frame and a reconstructed image in accordance with the set of image patches and the scan trajectory, wherein generating the set of image patches comprises:

for each color channel of the target image frame:

generating an input data matrix for each time step of the scan trajectory by vectorising a plurality of image tiles of a transformed version of the target image frame corresponding to the time step of the scan trajectory, determining a plurality of basis functions using the P-NMF model based on the input data matrices for a number of time steps, and transforming the plurality of basis functions into image patches for the color channel; and superimposing the image patches for each color channel to generate the set of image patches.

11. The patch scanning display apparatus of claim 10, further comprising:

a controller configured to:

receive the target image frame via a video interface; and generate the modulation signal and the backlight signal.

12. The patch scanning display apparatus of claim 10, wherein the backlight signal and the modulation signal are received from a controller via an interface.

13. The patch scanning display apparatus of claim 10, wherein generating the backlight signal comprises:

for each time step of the scan trajectory:

calculating, for each light-emitting element of the backlight, a difference between a target image frame and a reconstructed image at one or more locations corresponding to the light-emitting element, wherein the reconstructed image is determined in accordance with the following equation:

$$R(x, y) = \sum_{t=t_0}^{t_n} T((O_t \odot S_t),\ t)\left(1 - e^{\frac{t_n - t}{\tau}}\right),$$

wherein $O_t \odot S_t$ represents an element-wise multiplication of the backlight signal $O_t$ at time step t with modulation signal $S_t$, T represents a transformation based on the scan trajectory, $t_n$ represents a number of time steps in a frame period, and $\tau$ represents a time constant associated with a human visual system (HVS); and determining the backlight signal at that time step based on the difference.

14. A non-transitory computer-readable media storing computer instructions for reconstructing a target image frame using a patch scanning technique that, when executed by one or more processors, cause the one or more processors to perform the steps of:

receiving the target image frame;

generating a set of image patches corresponding to the target image in accordance with a decomposition model and a scan trajectory, wherein the decomposition model comprises a projective non-negative matrix factorization (P-NMF) model;

generating a modulation signal for a spatial light modulator (SLM) based on the set of image patches; and generating a backlight signal for a backlight for each time step in a plurality of time steps of the scan trajectory, wherein generating the set of image patches comprises:

for each color channel of the target image frame:

generating an input data matrix for each time step of the scan trajectory by vectorising a plurality of image tiles of a transformed version of the target image frame corresponding to the time step of the scan trajectory, determining a plurality of basis functions using the P-NMF model based on the input data matrices for a number of time steps, and transforming the plurality of basis functions into image patches for the color channel; and superimposing the image patches for each color channel to generate the set of image patches.

15. The non-transitory computer-readable media of claim 14, wherein the backlight signal is encoded based on an encryption key, the method further comprising receiving a request for the encryption key from a client, wherein the request includes credentials utilized to determine whether the client is permitted access to reconstruct the target image frame.

* * * * *